US007690281B2

(12) United States Patent
Hobgood

(10) Patent No.: US 7,690,281 B2
(45) Date of Patent: Apr. 6, 2010

(54) TONG POSITIONING AND ALIGNMENT DEVICE

(76) Inventor: John Paul Hobgood, 234 Ouiski Bayou Dr., Houma, LA (US) 70360

( * ) Notice: Subject to any disclaimer, the term of this patent is extended or adjusted under 35 U.S.C. 154(b) by 119 days.

(21) Appl. No.: 11/853,433

(22) Filed: Sep. 11, 2007

(65) Prior Publication Data

US 2009/0065189 A1 Mar. 12, 2009

(51) Int. Cl.
*B25B 13/50* (2006.01)
*B25B 29/00* (2006.01)

(52) U.S. Cl. ..... 81/57.35; 81/57.4; 81/57.16

(58) Field of Classification Search ..... 81/57.35, 81/57.15, 57.4, 57.44, 57.33, 57.16, 57.34, 81/57.19

See application file for complete search history.

(56) References Cited

U.S. PATENT DOCUMENTS 4,099,429 A * 7/1978 Hauk ..... 81/57.17
4,274,778 A * 6/1981 Putnam et al. ..... 414/22.71
4,401,000 A * 8/1983 Kinzbach ..... 81/57.15
4,402,239 A * 9/1983 Mooney ..... 81/57.16
4,573,359 A * 3/1986 Carstensen ..... 73/761
4,648,292 A * 3/1987 Haynes et al. ..... 81/57.16
6,318,214 B1 11/2001 Buck
7,104,316 B1 * 9/2006 Hobgood ..... 166/77.51
7,455,128 B2 * 11/2008 Belik ..... 175/162
7,559,360 B2 * 7/2009 Hobgood ..... 166/85.1
2009/0126536 A1 * 5/2009 Begnaud et al. ..... 81/57.34

* cited by examiner

*Primary Examiner*—Hadi Shakeri
(74) *Attorney, Agent, or Firm*—Jones, Walker, Waechter, Poitevent, Carrere & Denegre, L.L.P.

(57) ABSTRACT

A tong positioning apparatus including: (a) a base having a powered cylinder; (b) a first articulating arm attached at a first end to the cylinder and pivotally attached to the base; (c) a second arm attached at a first end to a second end of the first articulating arm; (d) a tong attached to a second end of the second arm, so that when the cylinder moves from retracted and expanded positions, the first and second arms articulate to move the tong between engaged and disengaged positions relative to conjoined tubular members; and (e) a bow structure forming an interface between the tong and the second arm that enables rotation about a generally vertical axis and with respect to an underlying support surface.

8 Claims, 30 Drawing Sheets

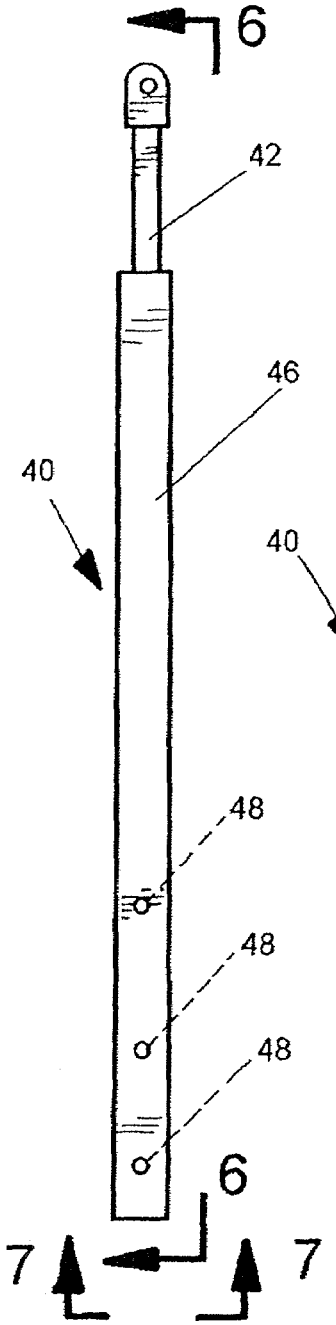
FIG. 5
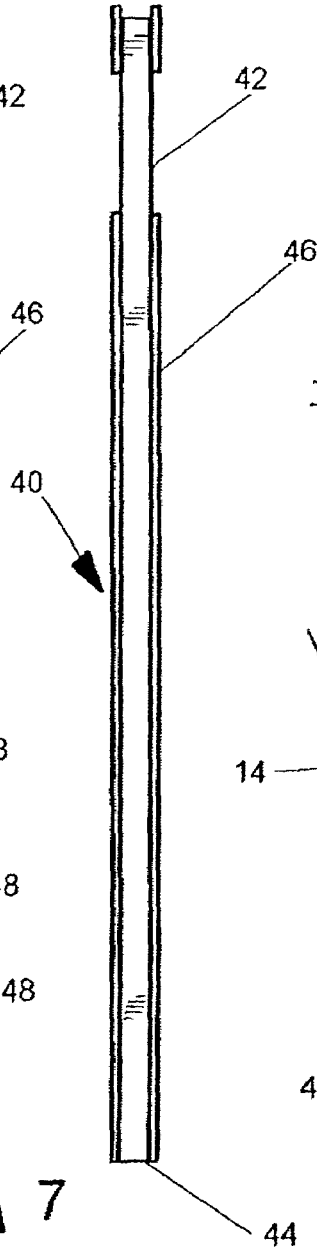
FIG. 6
FIG. 4
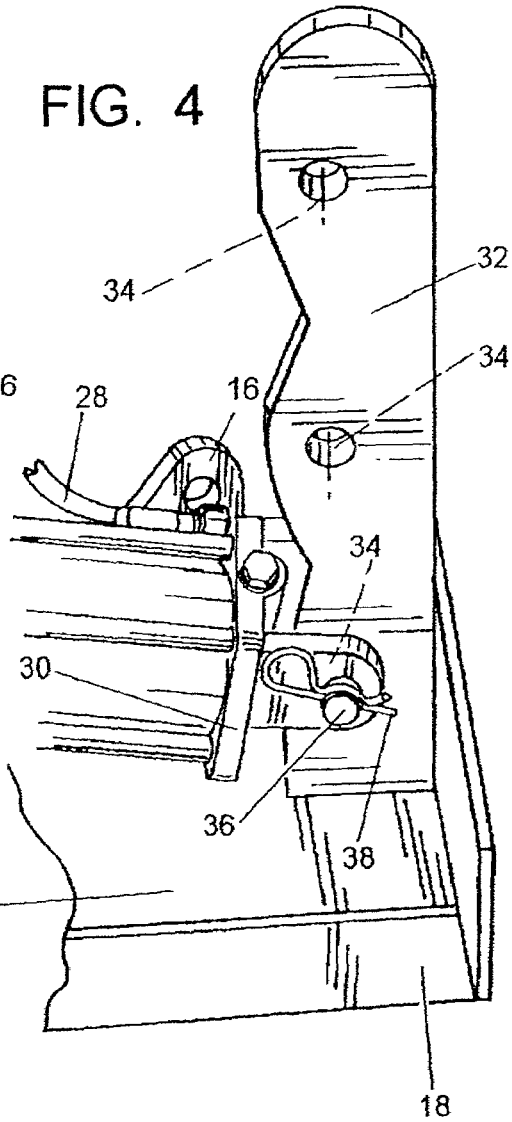
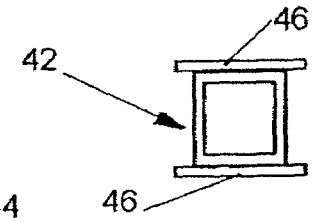
FIG. 7

TONG POSITIONING AND ALIGNMENT DEVICE

CROSS-REFERENCE TO RELATED APPLICATIONS

U.S. patent application Ser. No. 11/530,812, filed 11 Sep. 2006, is incorporated herein by reference.

U.S. patent application Ser. No. 10/807,708, filed 24 Mar. 2004 (now U.S. Pat. No. 7,104,316), is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Technical Field of the Invention

The present invention relates to oil field devices. More particularly, the present invention relates to an apparatus which has the ability to position and properly align a power tong around sections of oil field pipe on the rig floor by a single deck hand.

2. General Background of the Invention

In the drilling and completion phases in exploring for oil and gas, pipe tongs have been utilized for engaging lengths of casing, drill or completion pipe, known generally as tubular members, end to end, by rig floor personnel operating power tongs directly and in close proximity to the tubulars on the rig floor. A typical power tong comprises a first set of jaws which hold one section of pipe stationary while a second set of jaws rotate the next section to make up or break up the joint. The power tongs may weigh a few thousand pounds and are usually supported from the rig by a cable that allows the power tong to be moved manually by the rig floor personnel to engage the pipe, or disengage from the pipe, and be positioned away from the pipe string, to allow other work to proceed. Interconnected by a hydraulic cylinder, often referred to as a 'lift' cylinder, the power tong is connected on the one end to the rig cable and to the other end there attached to the power tong. The hydraulic cylinder allows the Power Tong Operator, from the operator's position at the Power Tong, to make Vertical corrections, both upwardly and downwardly to the Power Tong for positioning on the make or break out of the pipe. Such a lift system is illustrated in FIG. 19, labeled "Prior Art" is well known in the art.

However, because of the size of the power tongs, more than a single individual, often times two or three men, are required to move the tong into position, and operate the tong to make up or break the joint, and then to manually swing the tong, hanging from the cable, out of the way, and engage it in a position away from the pipe, so that the rig personnel can proceed to other chores. This manual operation of the tong in and out of position must be done with care, since the tong, swinging free from the cable, may strike one of the workers, or inadvertently disengage from its position and injure workers or damage materials on the rig floor.

Typically there are two types or composition of pipe or tubulars screwed together one piece to another, end to end, until the entire number of sections of pipe required for the job are joined together and run into the ground below the rig floor.

One composition of pipe is steel pipe which maybe screwed together without much care taken by the deck hand and/or the type of handling tool and power tongs to be used. However, another composition of pipe utilized for this type work is Chrome 13 or similar soft composition which requires much care when screwing one pipe section to another section requiring the Power Tong to be carefully placed on each section to prevent damage to the external coating of each pipe section. As the Power Tong comes in contact with each Chrome pipe section, care must be taken not to have damaging contact which may result in rapid deterioration once exposed to a harsh environment down hole. The difficulty in operating power tongs in this fashion has led to attempts to provide a different system to utilize and maneuver power tongs on the rig floor.

For example, U.S. Pat. No. 6,318,214 entitled "Tong Positioning Apparatus," discloses a power tong support apparatus having a frame, and a base movably positioned on the frame, with the power tong support attached to the base and movable to and away from the power tong. However, one of the drawbacks to this device is that the device requires a rather large and cumbersome frame to support the tong support member, which is not desirable because of the scarcity of rig space. Further, the device does not appear to allow the tong support member to operate at variable heights from the rig floor, which is necessary, since the pipe sections may be connected and disconnected at various heights above the rig floor.

In addition to the patent cited above, applicant is submitting herewith an information disclosure statement which includes additional prior art that applicant is aware of at this time.

BRIEF SUMMARY

The present invention solved the problems in the art in a simple and straight forward manner.

In one embodiment what is provided is an improved tong positioning and alignment apparatus which includes abase with a drip pan, designed to capture accidental oil spill or drip from the system, positionable on the rig floor; a hydraulic cylinder positioned on the base, having a first end engageable to a rear support member and a second end engageable to a pivotal moment arm; a forward shock attachment arm(s) engaged at a first end to one of three attachment points on the moment arm, and a second end which attaches to a tong frame attachment point(s) on the tong. The (single) moment arm may be bilaterally functional provided the system has a pivotal shaft extending outwardly on each side of the forward support member whereby the forward end of the moment arm actually has two forward ends, one each on each side of the forward support member and each having multiple bores thus emanating the structure for an additional forward shock absorber attached thereof.

Further, the tong frame is designed with a forward tong frame pivotal attachment member to accommodate a forward shock absorber on each side which additionally provides greater strength and stability during the torque process and further limits the bending and shearing effect of the tong while in tension with the tubular section. The greater the stress established through the bending and shearing effect applied to the threaded connection, the greater the probability the torque turn graph may display a bad connection thus the potential to discard that particular threaded section. Each forward shock attachment arm includes a pair of shock absorbers engaged along its length to provide a smooth, non-jerking motion both vertically and horizontally in moving the power tong. Each forward shock attachment arm may also be designed with more than two shock absorbers or the use of only one single shock absorber is desirable if the handling procedure with the size and weight of each power tong thus dictates the need for such. The tong positioning apparatus is designed to be remotely operated by hydraulic, air, air over hydraulics, electronically, hard wired or wireless or otherwise by a single operator. There is further provided a plurality of attachment points on the rear support member, and a plurality of pivot points for the moment arm, to allow for various vertical and horizontal positioning of the tong during makeup and breakup of pipe on the rig floor. Further, the apparatus includes a safety shield system to insure the workers are protected from inadvertent contact with moving parts of the apparatus.

Further there is provided a means for aligning the pipe within the tong apparatus by so that pipe, such as Chrome 13, or similar soft pipe, can be carefully guided into the tong, and eased in position, without the pipe wall making forceful contact with the tong. There is further provided at least two cameras which view the entire operation so that the manipulation of the pipe can be accomplished by an operator from a remote location.

In one embodiment is provided an improved tong positioning and further to provide an alignment apparatus which insures a safe working environment and saves time, promotes efficiency and reduces fatigue while operating power tongs on a rig.

In one embodiment is provided a tong positioning and alignment apparatus which requires a minimum of rig space, is able to be operated by a single deck hand through a power system operated at the location of the power tong operations or remotely operated from any location on the rig floor.

In one embodiment is provided a tong positioning and alignment apparatus wherein a hydraulic cylinder or air cylinder, hydraulic motor, chain or belt drive, cam over action or otherwise any driver when activated, operates a moment arm, pivotally attached to a forward support member, which is attached through a shock absorbing member downward or otherwise vertically, upwardly or downwardly, or horizontally to a forward pivotal support member on the power tong frame to allow forward and rearward movement of the power tong at various heights above the rig floor.

In one embodiment is provided a tong positioning and alignment apparatus engineered to provide strength and stability to contain the predetermined rotational force of the tong and prevent potentially serious injury to any deck crew member should the snub line fail or be improperly adjusted. It is well known in the art that great torque is applied to the pipe by the upper tong jaws as the lower tong jaws hold the pipe in place. With such great torque applied to the pipe section presents the possibility of malfunction of the lower tong jaw which restrains the pipe while the upper tong jaw is making up the threaded connection to the desired torque value. Should the lower jaw fail and the upper tong continues its predetermined rotational path, the present invention is designed to contain and prevent said rotational path of the upper tong and further prevent possible serious injury or death to the rig crew members.

In one embodiment is provided a tong positioning and alignment system which includes a protective frame and cover which can be retracted in and out of position when necessary.

In one embodiment is provided a tong positioning device which incorporates a shock absorber system to allow the jaws of the device to contact soft pipe, such as chrome pipe, without damaging the wall of the pipe.

In one embodiment is provided a tong positioning and alignment device which incorporates a tubular guide plate on the tong but preferably attached on the hydraulic back-up, or lower tong, to allow the soft pipe, such as chrome pipe, to be gently guided into the open throat of the tong and further to the tong jaws without damaging the wall of the pipe.

In one embodiment is provided a tong positioning and alignment device equipped with opposing intrinsically safe explosion proof video cameras in close proximity to the tubular guide plate and attached thereon. The video cameras are positioned to view each tubular section and further having a monitor mounted on the power tong visible to the tong operator and further a monitor located in the office of the rig supervisor to be utilized by the power tong operator and/or the rig supervisor as an aid to VHS or digitally record for later retrieval of said video for viewing and evaluation of (and store) the effect of the power tong positioner and alignment apparatus relative to the tubular guide plate in respect to the proper alignment of the upper jaw—die to each tubular section. In the event a problem is detected later in the completion phase, the VHS or digital recording is reviewed to determine if problems were associated with the tubular alignment and makeup procedure.

In one embodiment is provided a tong positioning device which requires minimum rig floor space, fewer personnel to work in a safer environment; makeup and break down pipe faster with less effort; and could be operated from a remote location on the rig floor.

In one embodiment is provided a power tong alignment system which is compact and easily attachable to the lower power tong and comprises the forward pipe section guide plate with pipe section/power tong alignment pads, two opposing intrinsically safe video cameras with view of the pipe section as the power tong is aligned and positioned on each pipe section, one on each side of the lower tong. Further, the power tong alignment system includes the tong door system which is operated by the power tong operator.

In one embodiment is provided a power tong well bore radial positioning and attachment device set out on a horizontal plane. In the running of casing, the power tong may utilize only the upper jaw set to rotate the upper tubular member while the lower tubular member is held in place by conventional manual tong(s) immobilized in place by a very strong cable referred to in the industry as simply a 'snub line' and further a snub line of approximate identical proportions is attached at the one end of the snub line to the line pull attachment located to the portion of the power tong away from the well bore and further the second end of the snub line cable is attached permanently to a rig vertical leg support or otherwise attached to a permanent substructure snub line attachment point as part of the rig floor and further the lower tubular member may be held in place by a mechanical slip bowl mechanism inset at the well bore and the sheer weight of the combined tubular string prevents inadvertent rotational movement of the lower tubular body.

In one embodiment the power tong, as it relates to the snub line, is directed or positioned in the makeup or backout mode and the power tong, under extreme torque application and further as the tong begins the anticipated rotational process in relation to said tubular, that portion of the power tong using the measurement farthest from the well bore center commonly known in the industry as the (handle arm length or handle length), the torque application hereof causes said power tong to swing forcible into a predetermined radial arc such as determined proportionally by the length from the well bore center to the snub line attachment point at the rear of the power tong (handle length), thus causing the snub line to become taunt while in effect the power tong while being supported by a cable shifts position somewhat on the radial axis in relation to the well bore and handle length. The horizontal position shift of the power tong is in direct relationship with the power tong as torque is applied to the tubular member in either the make up or back out mode.

In one embodiment this radial arc as herein implied and suggested refers to the logically necessary sequence of events in relation to the distance from the center of the well bore to the point of attachment to the power tong (handle length) with the snub line therefore the requirement for the utilization of the current invention when said power tong is 'pushed or positioned' by a positioner and control device or otherwise a robotic arm.

In one embodiment is provided a mechanism to prevent damage to the connection arm of said positioner and/or to cause the power tong to shift along the 'radial arc' gently controlled by coil spring(s) (with 10.198 lb/in or 1.1522 newton/meter), shock absorber(s) or otherwise that may be required as established through the logically necessary sequence of events.

In one embodiment is provided an apparatus where as torque is applied by the power tong causing the handle length end of the power tong to advance in the direction determined by the make up or break out procedure.

In one embodiment as further defined by the 'handle length' to advance in either direction depending on the make up or break out of the tubular member. In one embodiment is provided an apparatus which allows for the said radial movement relating to the axial well bore assignment of the power tong and as the torque increases causing handle length rotational movement to said power tong to gently rotate without damage to the power tong or positioner.

In one embodiment is provided an apparatus where the connection torque value between the lower tubular member and upper tubular member is made up as predetermined, the power tong, with the assistance of the integral memory mechanism, positions the power tong to the proper alignment and the power tong is released from the tubular member, assumes the original inline position and the power tong is extracted from the make up break out position to the secure position away from the well bore and tubular member at which time the tubular member is lowered down hole by the drilling rig crew.

In one embodiment is provided an integral memory mechanism composing a 1.5 inch (3.81 centimeter) solid steel radial bow designed to the parameters set out herein and designated through said distance achieved utilizing the parameters from the well bore center to the end of the power tong.

In one embodiment is provided an apparatus where the handle arm length therein integrated with a series of tension/compression springs (at 10.198 lb/in or 1.1522 newton/meter) coupled with 'v' groove steel roller bearings in conjunction with 2 inch (5.08 centimeter) solid steel radial bow stock with steel guide roller bearing for ease of movement throughout the predetermined radial arc.

In one embodiment is provided a radial attachment apparatus that insures a safe working environment and saves time, promotes efficiency and reduces fatigue and further provides a smooth transition of the power tong from the torque position on the tubular member to the relative horizontal plane of the power tongs when removed from the tubular member on the rig floor.

In one embodiment is provided an improved Power Tong Well Bore Radial Apparatus which includes a base positionable on the Power Tong; an arm having a first end engageable to the Power tong rear support member and a second end engageable to the housing of the invention; a radial solid round bar positionable with 'V' groove steel bearings which are centered on the round bar; a solid square bar or rectangular bar with identical radial measurements as the above and further supported by roller bearings.

In one embodiment is provided a tong positioner having the ability to facilitate radial and/or horizontal positioning of a power tong around sections of oil field pipe or casing on the rig floor by a single operator at the equipment or remotely through hydraulics, wireless or otherwise.

One problem with operating the power tongs when connected to only an upper tubular (and the lower tubular being rotational fixed by some device independent of the power tongs) is that relatively large dynamic rotational reaction forces (reacting to the rotational torque being applied to the upper tubular member) will be transferred back to the power tongs and then back to through to the tong positioner. These dynamic rotational forces can in some instances damage, bend, or cause portions of the tong positioner (such as the connecting arm) to fail prematurely. In one embodiment the size of these relatively large dynamic rotational reaction forces (which are ultimately transmitted to the tong positioner) can be reduced and/or minimized by allowing a relative rotational movement (in a substantially horizontal plane) between the powered tongs and the tong positioner. In one embodiment this allowed relative horizontal rotation between the powered tongs and the tong positioner is called a floating connection between these two devices.

In one embodiment this relative rotational movement can occur along a predetermined rotational radial arc of the powered tongs relative to the tong positioner. The radius of curvature of this predetermined arc is expected to be the distance between the center of the upper tubular member and the connection point between the powered tongs to the tong positioner. In one embodiment the amount of the size of the radial arc can be adjustable for accommodating different sized powered tongs with different distances between the connection point between the tong positioner and the point of rotation for the powered tongs (e.g., the center of the upper tubular member). In one embodiment adjustment of the radial arc can be obtained by the switching out of radial arc members from a set of different predetermined radial arc members. In one embodiment adjustability can be obtained by having the radial arc member comprised of a plurality of pieces and the pieces being pivotal to different radius of curvature. In one embodiment the radial arc member can be bendable.

In one embodiment a type of universal predetermined arc can be obtained when spaced apart rollers are used which can enlarge and reduce the amount of spacing between the rollers. Where the rollers expand, the expansion can accommodate a range of arcs of different radii.

In one embodiment a pair of springs can be used so that relative rotational movement will cause one spring to expand and the other spring to compress. In this situation the two springs can be said to have a memory where, after the dynamic rotational reaction forces subside, the two springs will tend to move the powered tongs back to the relative rotational position seen before the dynamic rotational reaction forces were first applied. In one embodiment the biasing member(s) are called an integral memory mechanism which automatically positions the power tongs in a proper alignment situation, after the upper tubular member is released by the power tongs, and before the next application of the powered tongs to an upper tubular member. This would be after the dynamic reaction torque on the powered tongs subsides.

In one embodiment the integral memory mechanism can include a 1.5 inch (3.81 centimeters) steel radial bow (such as being designed to the parameters set out herein and designated through distance achieved utilizing the parameters from the well bore center to the end of the power tongs). In one embodiment along the handle arm length can be provided a series of tension/compression springs (preferably with spring constants of about 10.2 lb/in or 1.15 newton/meter) coupled with 'v' groove steel roller bearings. In one embodiment a 2 inch (5.08 centimeter) solid steel radial bow stock with steel guide roller bearings can be used for ease of movement throughout the predetermined radial arc.

In one embodiment the amount of force resisted by the radial springs when compared to the torque applied by the power tongs is negligible. In this embodiment the powered tongs can substantially freely float (rotationally in a horizontal plane) relative to the positioner so that horizontal rotational torque loading transmitted from the power tongs to the positioner is minimized—thereby minimizing any damage to the positioner arm from bending loads. In this embodiment a snub line ultimately stops the powered tongs from rotating in a horizontal plane. The snub line can also include a load cell measuring the force applied by the power tongs on the snub line which force can be converted to the torque on/from the tubular when the moment arm "handle" is taken into account. The moment arm "handle" can be the radial distance from the center of the tubular to the connection point of the snub line.

In one embodiment the radial spring is strong enough to overcome friction and reposition the powered tongs relative to the tong positioner (after the dynamic or shock torque loading subsides from the powered tong tightening or loosening the tubular) to its original radial starting position relative to the positioner. The strength of the radial spring would have to overcome the frictional forces from the rollers and the bow.

In one embodiment, to provide a "true" torque reading from the load cell on the snub line, the relatively small amount of forces applied by the radial spring should be specified and given to the rig so that the rig can take this force into account when calculating the "true" torque applied by the power tong on the tubular (instead of merely the force read by the loading cell on the snub line). As the resistance of the radial spring will reduce somewhat the force read by the load cell (although this may be negligible) because the radial spring does somewhat resist rotation of the power tong.

In one embodiment this relative rotational movement can be dampened through mechanical means such as frictional resistance along with in addition of one or more biasing means (helical springs and/or other type springs). In one embodiment the risk of damage to the connection arm of a tong positioner is reduced and/or eliminated by allowing the power tongs to shift and/or turn along a "radial arc" while such shifting/turning is gently resisted by one or more dynamic and/or shock loading absorption devices (such as one or more springs (e.g., having spring constants of about 10.2 lb/in or 1.15 newton/meter) which can also include dampening devices (such as shock absorber(s))).

In one embodiment specific dampeners (e.g., shock absorbers) can be used to further dampen and/or reduce the amount of the dynamic rotational reaction forces ultimately transmitted to the tong positioner. In one embodiment the amount of resistance to relative rotational movement between the tong positioner and the powered tongs can be adjusted (such as by allowing the switching out of springs with different spring constants or a screw type adjustment which tightens the springs).

In one embodiment an on/off switch for allowing/disallowing relative rotational movement between the powered tongs and the tong positioner can be provided which can stop and/or restrict the allowed relative radial movement between the powered tongs and the tong positioner

BRIEF DESCRIPTION OF THE DRAWINGS

For a further understanding of the nature, objects, and advantages of the present invention, reference is made to the following detailed description, read in conjunction with the following drawings, wherein like reference numerals denote like elements and wherein:

FIG. 4 illustrates an isolated view of the rear end of the hydraulic cylinder attached at one attachment point of the rear support member;

FIGS. 5 and 6 illustrate side and top views of the moment arm respectively;

FIG. 7 illustrates the moment arm in cross section view along lines 7-7 in FIG. 6;

DETAILED DESCRIPTION OF THE PREFERRED EMBODIMENTS

FIGS. 1 through 18 and 20 through 26 illustrate the preferred embodiment of the present invention; i.e., the improved tong positioning device (the "device") by the numeral 10. FIG. 19 illustrates a prior art lift system for a power tong, so that the operation of the present invention may be more fully explained.

Figure 1:
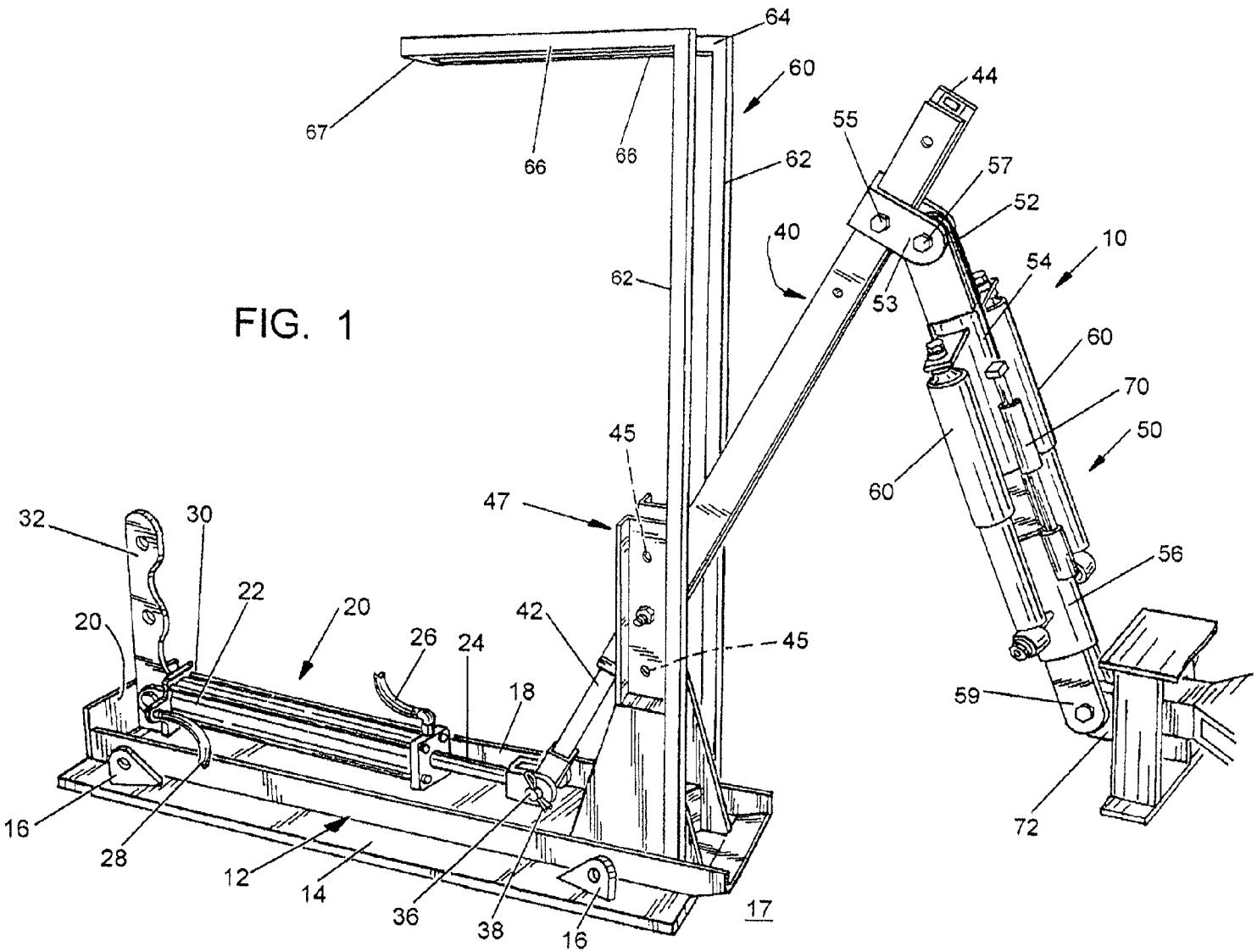
FIG. 1 illustrates an overall view of the preferred embodiment of the tong positioning system of the present invention.
Figure 2A:
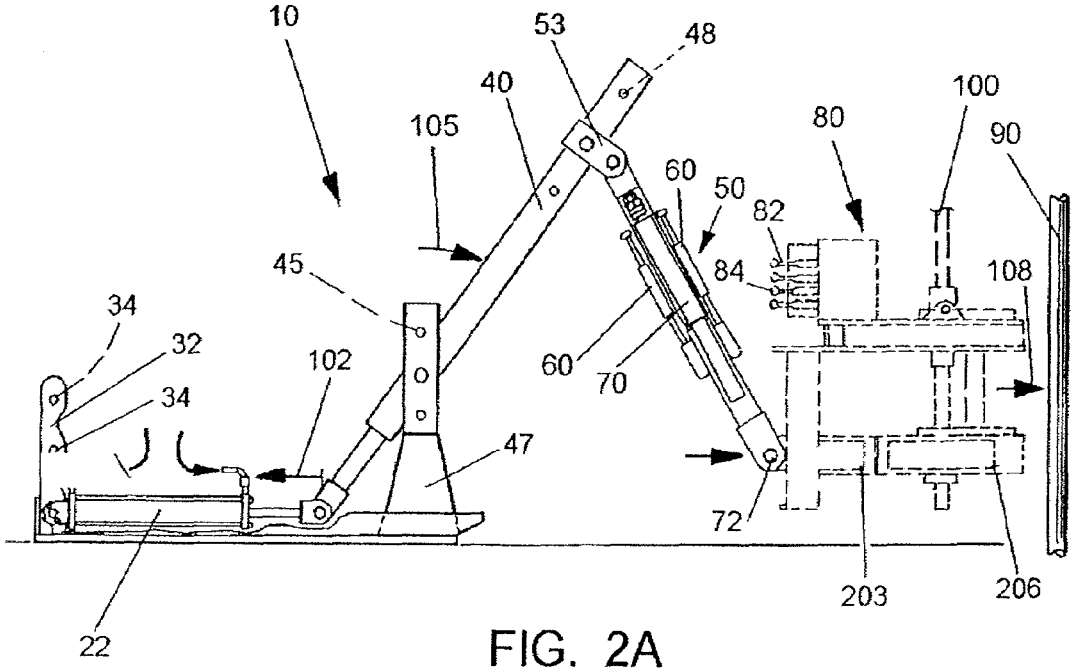
FIGS. 2A and 2B illustrate side views of the preferred embodiment of the tong positioning system of the present invention moving power tongs into and out of position relative to tubular members.
Figure 2B:
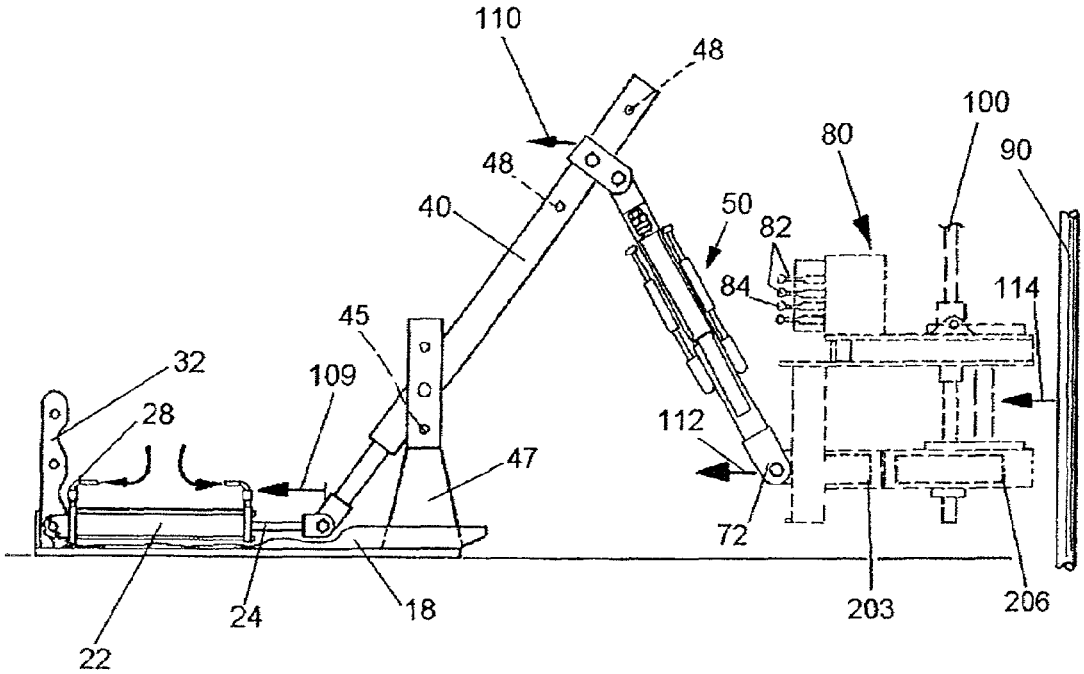
Figure 3:
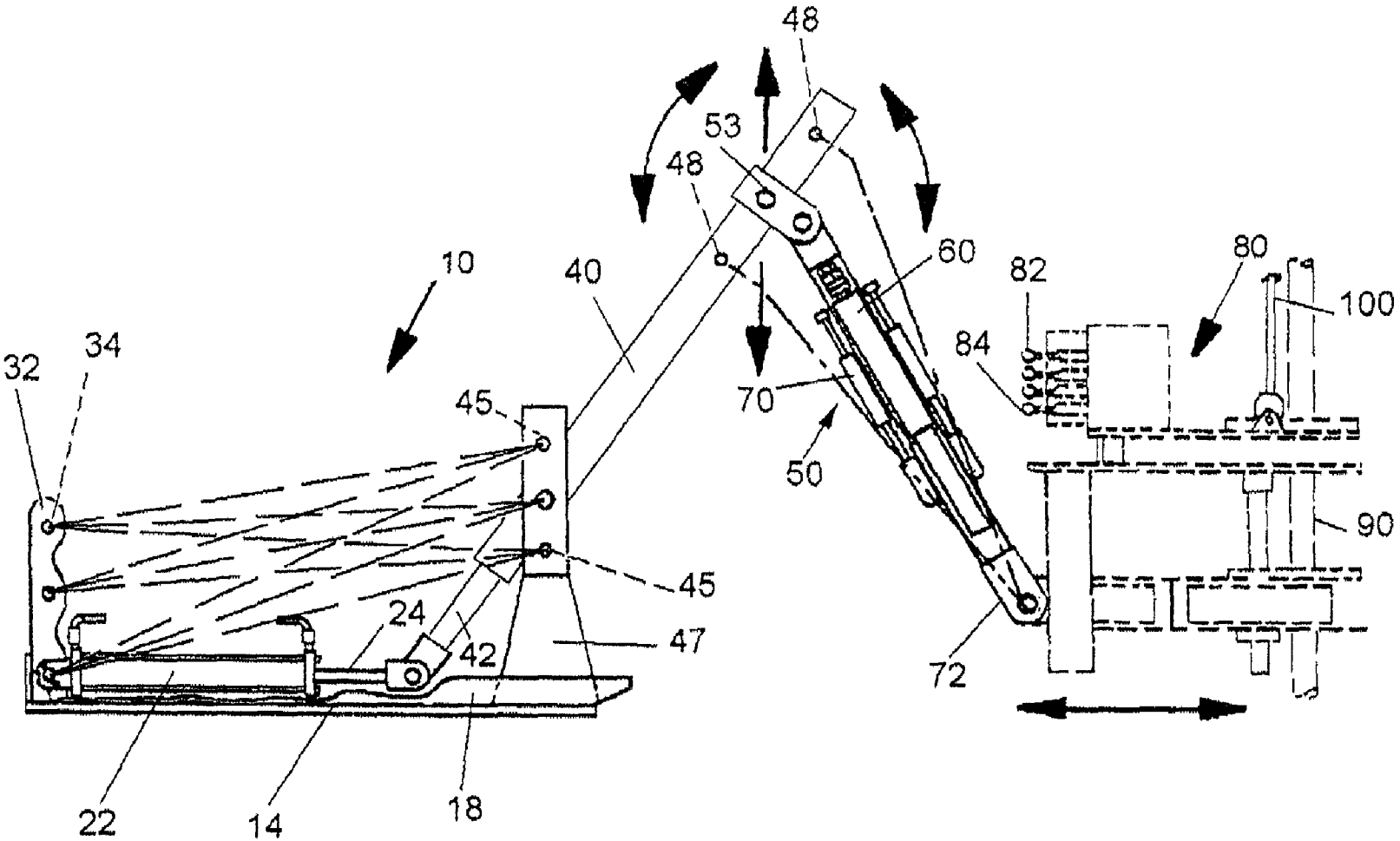
FIG. 3 illustrates a side view of the preferred embodiment of the tong positioning system of the present invention as it would be utilized in the plurality of positions on the rear support member, forward support member, and moment arm.

Turning first to the present invention, as illustrated in the various views, and in particular FIGS. 1 through 3, device 10 includes a base member 12 which comprises a flat base plate 14 of heavy iron or steel, having a lifting eye 16 at each corner for lifting device onto and off of a rig floor 17, and/or to aid in securing the device to the rig floor. There is further provided a rectangular container or box 18, having a plurality of walls 20, which would define a means for capturing any hydraulic or other type fluids which may be released from the device, and containing the fluids within the box 18, rather than the fluids flowing on the rig floor 17.

The rectangular container 18 would contain a power drive system 20, which as illustrated, comprises a hydraulic cylinder 22, having a piston member 24 movable within the cylinder 22, driven by hydraulic fluid pumped through lines 26, 28, as is commonly known in the art. Although a hydraulic cylinder, containing hydraulic fluid is illustrated and discussed, it should be made clear that the scope of the power system may include diesel hydraulics, forced air pressure, electronic signaling between a sender and a receiver, or other similar systems, such as a belt or chain drive or cam over system. As illustrated, the first end 30 of the hydraulic cylinder 22 is secured to a vertical rear support member 32 which would be secured onto base plate 14 through welding or the like, as seen in isolated view in FIG. 4. The end 30 of the cylinder 22 is engaged into a first lower port 34, and held in place with a pin 36 and a cotter pin 38. There are two other ports 34 along the length of the rear support member 32, the purpose to be explained further. Likewise, returning to FIGS. 1 through 3, the piston 24 as engaged at its end to the lower end of a moment arm 40, in the same manner that the first end 30 of the cylinder 22 is engaged to the rear support member 32, i.e., a pin 36 and cotter pin 38.

The moment arm 40 is a very important part of the device 10, and is illustrated in isolated views in FIGS. 5 through 7. As illustrated the moment arm 40 includes an inner arm member 42 substantially square in cross section, and extending from its first connection point to the end of piston 24, as described earlier, to its upper end 44, where it terminates. There is further provided a pair of reinforcement plate members 46 secured along substantially the entire length of inner arm member 42, via welding or the like, except for a lower portion of the arm member 42, which engages the piston 24, as seen in FIG. 1. As seen in the Figures, there are provided a plurality of bores 48 near the upper end 44 of the moment arm 40, the bores 48, being bored through both the inner arm 42 and plate members 46 as illustrated. These bores will serve as alternate connection points between the moment arm 40 and the forward shock attachment arm 50, as will be discussed. Further, as a means to easily adapt the Moment arm 40 with the ability to extend the forward shock attachment arm 50 greater distances, an extension arm with a like plurality of bores 48 and corresponding adjustment length of each forward shock attachment arm 50 may be bolted to the upper end 44 of the moment arm 40. The moment arm also includes a bore 48 along its lower end when pivotally engaged to a forward upright support member 47, which, like the rear support member 32, is welded to the lower base plate 14. The support member 47 as illustrated, includes three bores 45 which would allow the moment arm 40 to pivot from one of the three bores 45 in support member 47 depending on work circumstances, as will be discussed.

As is seen further in FIGS. 1 through 3, the base 20 of the device also provides for a frame 60, which includes a pair of upright members 62, extending from the base plate 14, vertically, along the forward support member 47, to a height above the base 20, then extending at a right angle at point 64, to terminate in a pair of horizontal members 66, terminating at ends 67. The function of the frame 60 will be discussed further.

Figure 8:
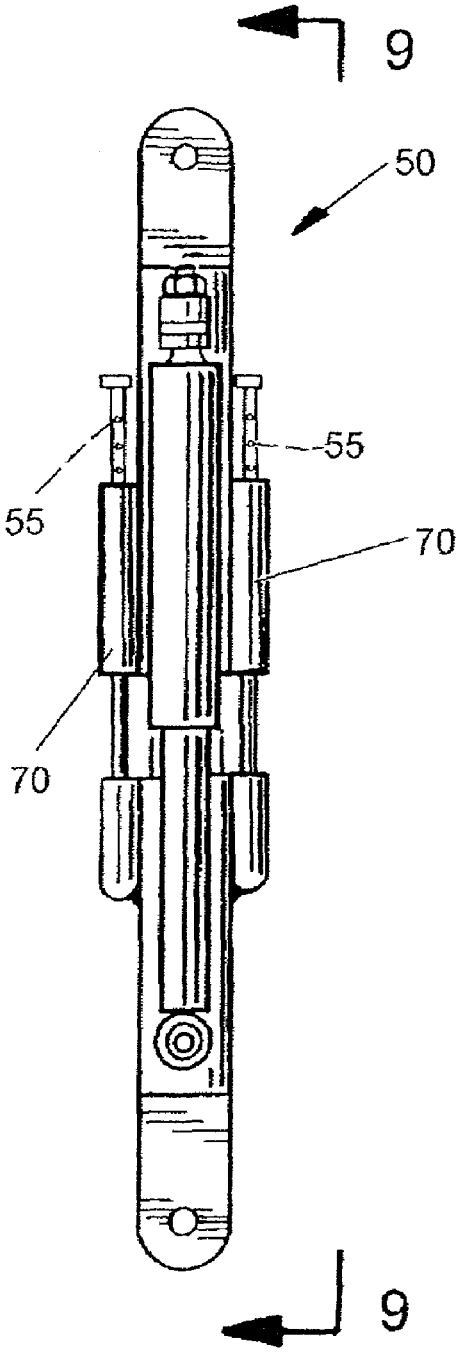
FIGS. 8 through 12 illustrate various views of the forward shock attachment arm during operation.
Figure 9:
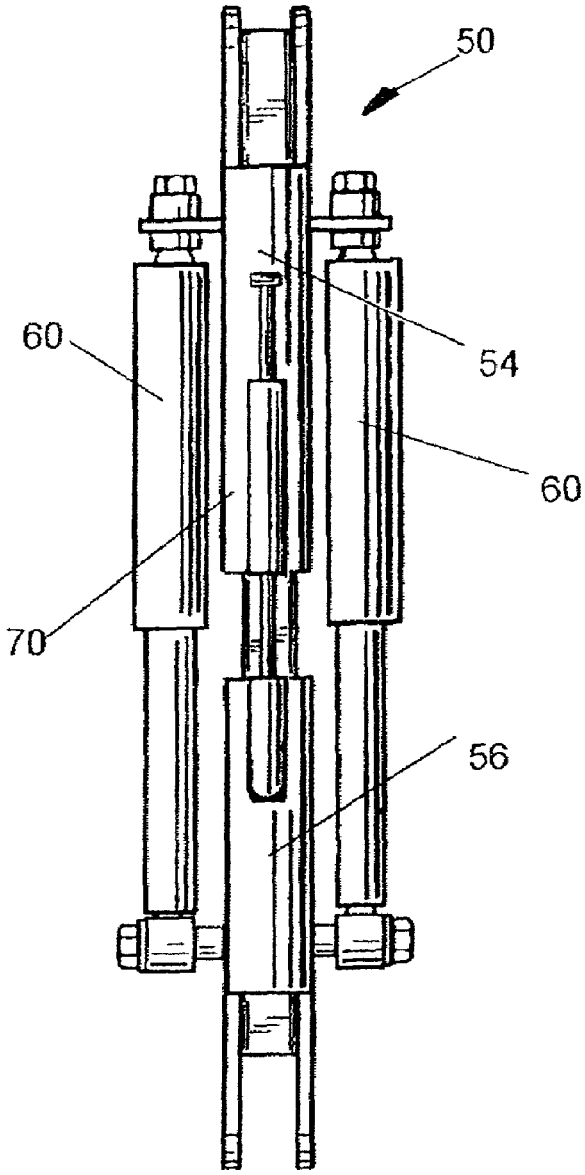
Figure 12:
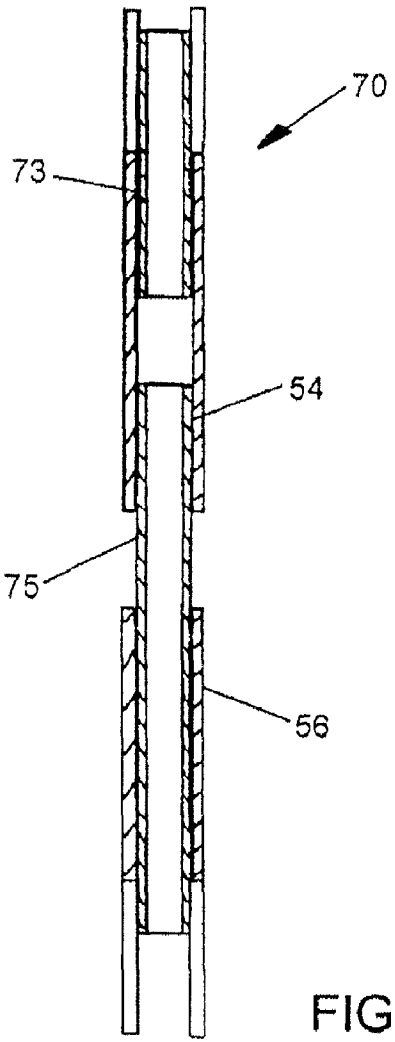
Figure 11:
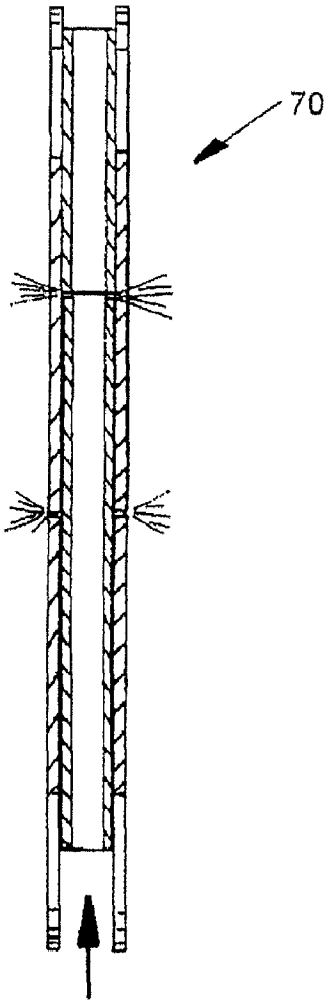
Figure 10:
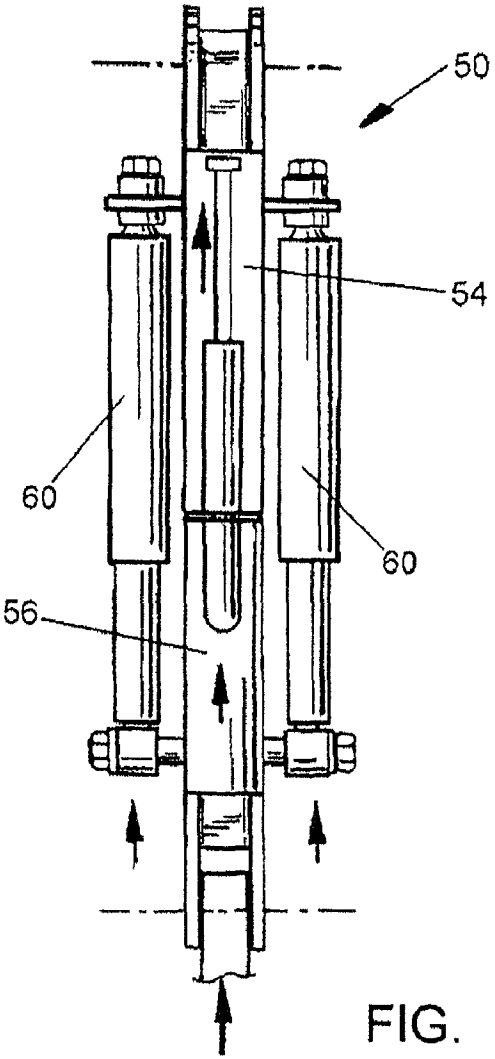

Returning to FIGS. 1 through 3, and making reference particularly to FIGS. 8 through 12, there is illustrated the forward shock attachment arm 50, which is engaged at a first end 52 to one of the bores 48 in the moment arm (in FIG. 1, connected at the mid bore 48), through the use of a u-shaped connector member 53, having a first connection point to the moment arm 40 via bolt 55, and a second open-ended connection point to the end 52 of attachment arm 50 via bolt 57. This allows pivotal movement between the moment arm 40 and the attachment arm 50. The attachment arm 50 comprises first and second portions 54, 56 which are engaged to one another by a pair of air or gas cylinders 60, positioned on either side of he portions 54, 56, as illustrated. There is further illustrated a pair of external members 70 for limiting the expansion and contraction of the attachment arm 50 during its operation while said external members are further utilized as stabilizing guides to reduce any shearing, bending and/or rotational movement of the forward shock limiter and combines to further support the designed alignment procedure of the Power Tong in relation to the Tubular Section. Also known in the art is the great amount of torque applied to the pipe by the upper tong jaws as the lower tong jaws holds the pipe 90 in place. These members 70 span across to each portion 54, 56, and would allow for limited expansion and contraction of the two portions 54, 56, into and away from one another as the case may be. There are provided ports 55 in the members 70, as seen in FIG. 8, to preset the desired limit of expansion and contraction. The movement of the two portions 54, 56 are controlled by the air cylinders 60, which afford a precise movement, and limits or eliminates a sudden, jerking movement of the apparatus as it would be utilized to move the tong into position around a section of tubular member or away from the tubular members after make up or break down. FIGS. 11 and 12 illustrate the limits in which the movement of the two members 54 and 56 relative to one another during use of the device, by the inward and outward movement of the two sections 73, 75 of the limit members 70.

The second end 59 of the attachment arm 50 is pivotally engaged at point 72 to the tong support member 74, via a single bolt 76, which also allows pivotal movement between the attachment arm 50 and the power tong 80. One example of such an attachment method would be seen in FIG. 19 in this application. It should be made clear that although the power tong 80 is secured to the device 10 at attachment point 72 between the attachment arm 50 and the tong 80, the device is being used primarily, if not exclusively to position the tong 80 onto and off of a section of pipe 90. In this embodiment, it is not supporting the very heavy weight of the power tong 80. The tong 80, as seen in FIGS. 2A and 2B, is being supported by (a hydraulic cylinder known as a lift cylinder, of the type of prior art lift cylinder, illustrated in FIG. 19, interconnected at each end to a cable 100, as is currently known in the art.

So, in general, as seen in FIGS. 2A and 2B, an operator would stand adjacent tong 80, and have access to the various operation handles 82, which are used to open and close the tong jaws and spin the pipe, all functions already known. However, with this device, the operator has access to a second set of handles 84 which operate the cylinder 22, to commence operation of the device. As seen in FIG. 2A, the tong 80 is engaged to the forward attachment arm 50 at point 72, as the tong 80 is suspended from a device as shown in prior art FIG. 19, by cable 100, near pipe 90. The upper end of the arm 50 is engaged to the upper end of the moment arm 40 at point 57, which allows pivotal movement between the two. The moment arm 50 is pivotally engaged along the middle opening 45 of the upper support member 47, with its lower end engaged to the piston 24 of the cylinder 22. In FIG. 2A, when the operator manipulates the hydraulic fluid to force the piston 24 rearward into cylinder 22 (arrow 102), the moment arm 40 is pivoted in the direction of arrow 105. When this occurs, the lower end 59 of the attachment arm 50 is forced in the direction of arrow 106, when begins to provide forward movement of the tong 80 in the direction of the pipe 90, arrow 108. Because of the construction of the attachment arm 50, including the cylinders 60, the movement of the tong 80 would be smooth, and when the tong jaws would make contact with the wall of the pipe 90, the contact would be cushioned and would not damage the pipe wall. This is particularly important when brass or other soft metal, such as chrome tubular members are being used in the operation. Of course, when the device 10 has engaged the tong 80 on the pipe, and the operation is complete, the operator would activate the hydraulic fluid to flow to the rear of the piston 24, through line 28. The piston 22 would be forced out from cylinder 22, arrow 109, and in doing so, would pivot the upper end 44 of the moment arm 40 in the direction of arrow 110, which would pull the lower end 59 of the attachment arm 50 in the direction of arrow 112, and in turn moving the tong 80 away from the pipe 90, in direction of arrow 114. This operation would allow smooth movement of the tong 80 to engage and disengage from the pipe 90.

One particular feature not yet discussed in the operation and construction of the device 10 is its ability to effect different vertical and horizontal movements between the moment arm 40, attachment arm 50 and the tong 80, based upon the relative position of the tong 80 on the rig floor, which may also function when utilized in conjunction with the hydraulic lift cylinder interconnected between the rig cable and the tong. This ability is illustrated in FIG. 3 and FIG. 19, Prior Art). As was discussed earlier, rear support member 32 included a plurality of bores 34 to which the rear end 30 of the cylinder 22 could engage. Likewise, the forward upright support member 47 included a plurality of bores 45 in which the moment arm 40 could pivot along its path. Further, the upper end 44 of the moment arm 40 included a plurality of bores 48 in which the end of the attachment arm 50 could engage. The function of these various attachment choices between the cylinder 22, moment arm 40 and attachment arm 50 is illustrated in FIG. 3. As seen, for example, when the cylinder is attached to the upper most bore 34 of the rear plate 32, the angle and distance of the movement of the piston 24 would be changed, which would effect the movement of the moment arm 40 relative to the movement of the attachment arm 50. Since there are three different attachment points on the rear plate 32, three different attachment points for the moment arm 40 on the forward plate 47, and three different attachment points between the end 44 of the moment arm 40 and the attachment arm 50, the various combination of the attachment points would modify the travel of the cylinder/moment arm/attachment arm combination relative to the movement of the tong 80. The overall effect would be the ability of the attachment arm 50 to engage the tong 80 at differing heights above the rig floor 17, without having to position the base 12 of the apparatus 10 at different heights on the rig floor. The combination of attachment points would compensate for these variations, which could be determined at each job.

Figure 13:
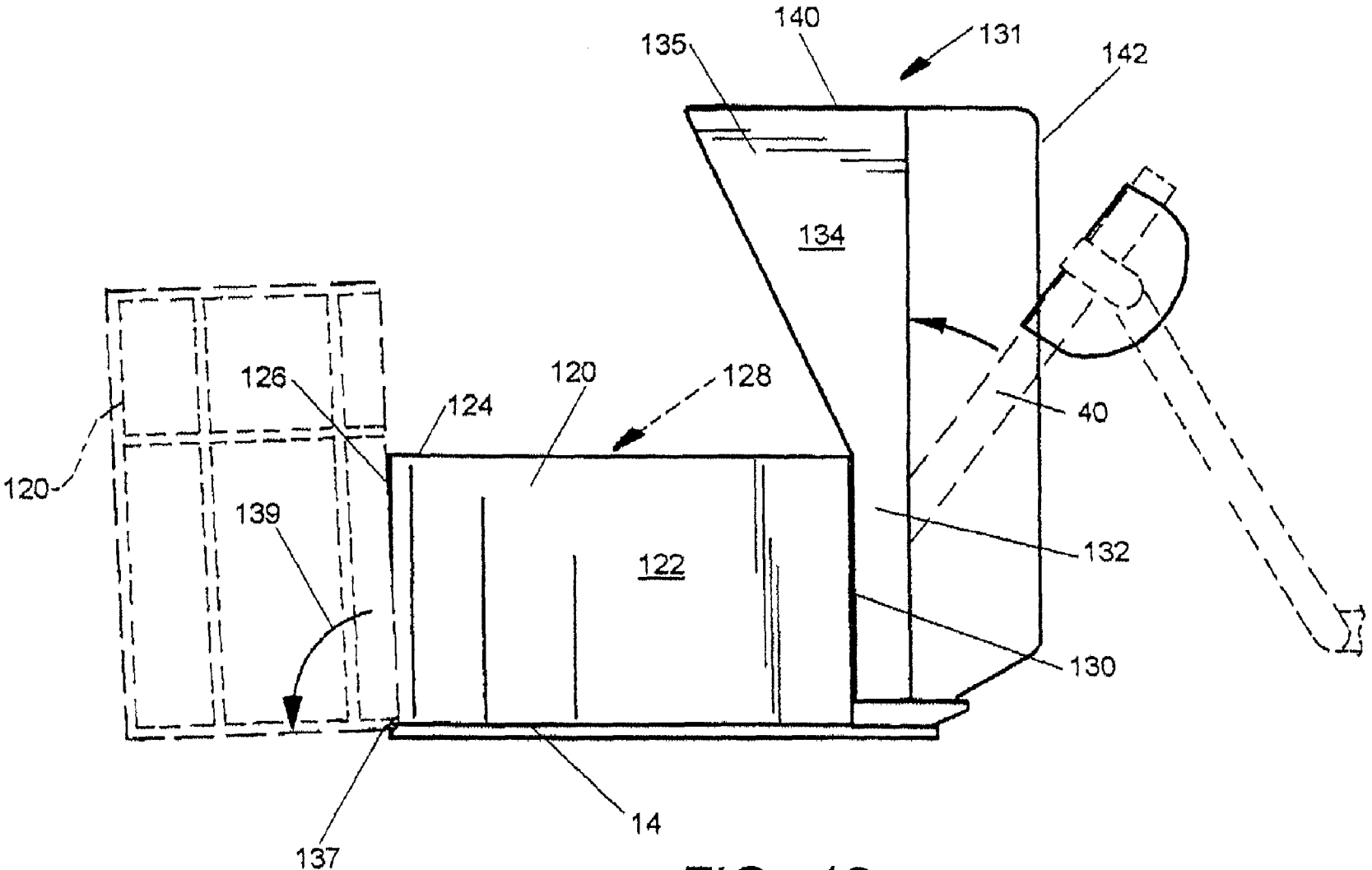
FIG. 13 illustrates a side view of the Frame and Cover system as it protects workers when utilizing the present invention.
Figure 14:
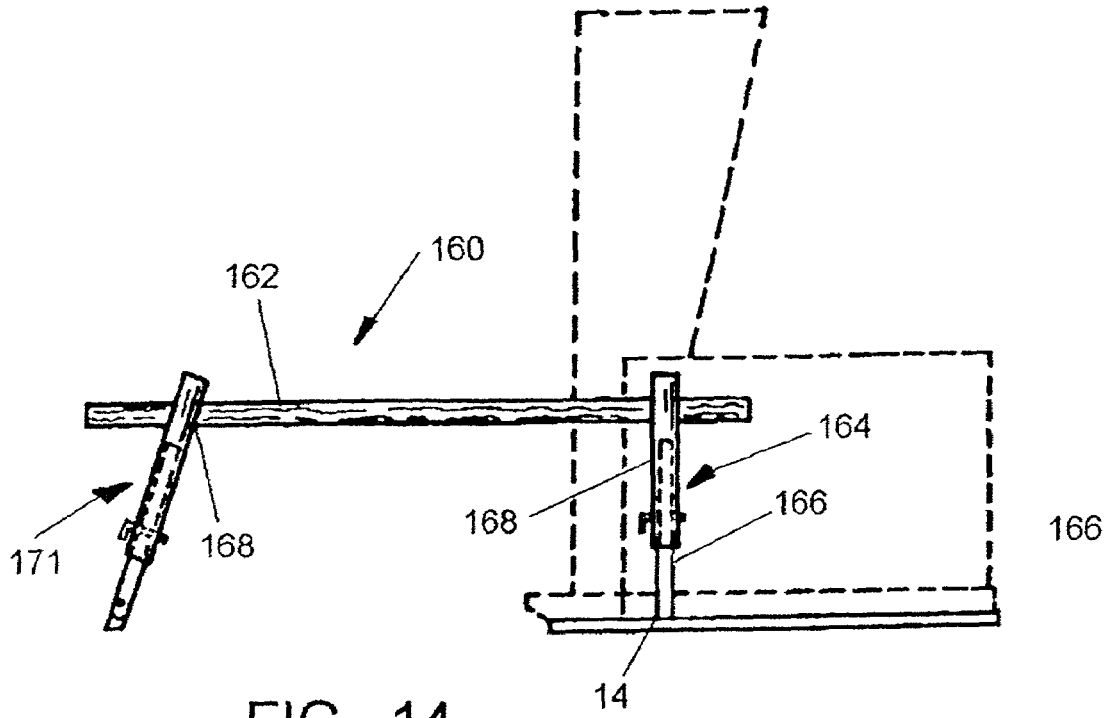
FIGS. 14 and 15 illustrate views of scaffolding which would be utilized when the invention is used in dual completion jobs, or otherwise any job running pipe into the hole whereby the threaded connection or makeup may not be positioned at the ideal makeup elevation in relation to the rig floor.
Figure 15:
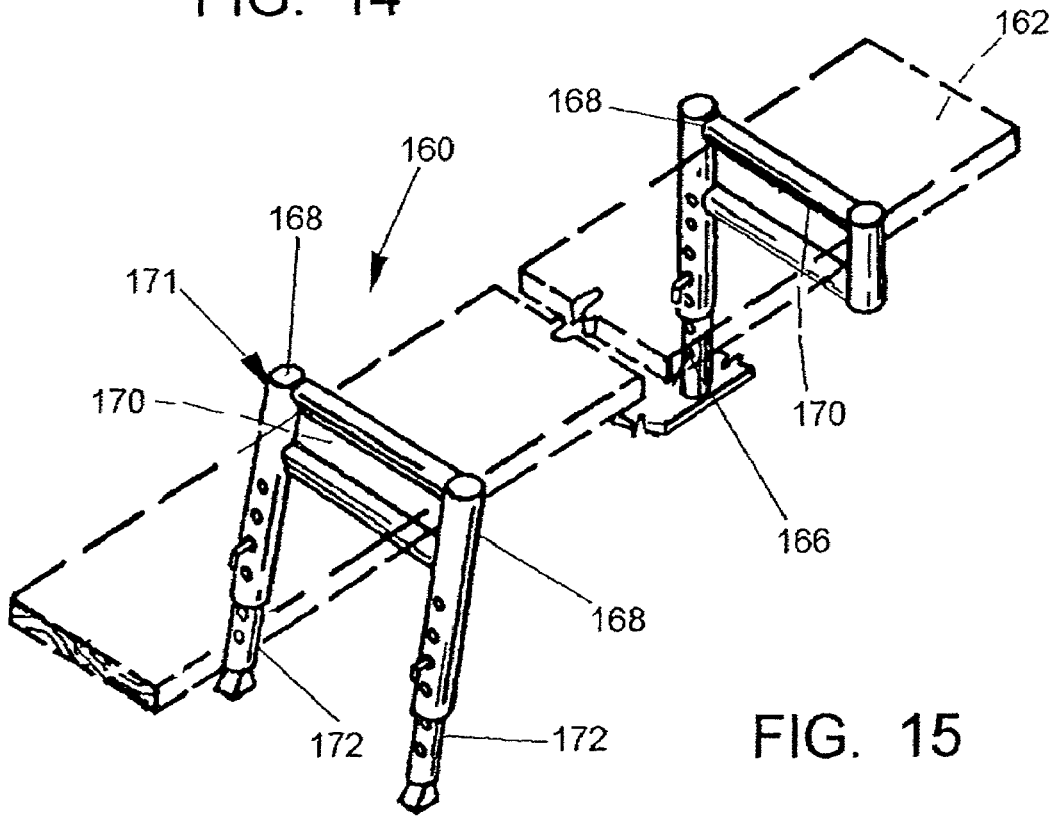

One important feature of the present invention, is because of its narrow profile; i.e., being no wider than the base upon which it rests, the apparatus 10 is able to be fully contained within a frame and cover as seen in FIGS. 13 through 15. As seen in overall side view in FIG. 13, the frame and cover would comprise two principal components. There would be provided a generally rectangular box portion 120 which would rest upon the lower base plate 14, and include a pair of sidewalls 122, an upper wall 124, and a rear wall 126, the walls defining an interior space 128 which, when the portion 120 is in position, as seen in FIG. 13, would completely cover the rear support member 32, the cylinder 22, piston 24 and the forward support member 47 and the container 18 which would house these members. Since the piston is engaged to the moment arm 40, the front face 130 of portion 120 would remain open, so as not to interfere with the connection between the piston 22 and moment arm 40.

Earlier, reference was made to the upright frame 60. This frame 60, as seen in FIG. 1, would allow a second component 131 of the cover to be set in place. This component 131 is illustrated in FIG. 13, also. It comprises an upright portion 132 which would have side walls 134, and a lower and truncated end wall 136 and would slide around the forward support member 47, and extend upward to a flared upper portion 138 which would be held in place by frame 60, discussed earlier. As seen in FIG. 13, the upper portion 138 includes the side walls 134, and a top portion 140; however, the forward face 142 of the component 130 would be left open. The reason for this is that even with the covers 120 and 130 in place, the device would still be allowed to operate, as seen in FIG. 13, with the moment arm 40 and attachment arm 50 seen in phantom view, as they would extend out from the opening in the face 142 of portion. When in this position, the operator would be protected from any inadvertent contact between the components which are under the covers 120, 130, which would greatly reduce the possibility of injury. Likewise, when not in use, the moment arm could be retracted to the vertical position within container 130, and the attachment arm would likewise fall to a complete vertical position, and would be shielded by the extended side walls 132 of the component 130, within the confines of the housing cover 130. There would be provided a semicircular plate 135 which would serve to shield a worker from contact with the connection point between the arms during operation.

Again, referencing FIG. 13, when accessing the interior of the housing 120, the housing 120 is hinged at point 137 along its rear end, so that the housing 120 could simply be rotated back in the direction of arrow 136, and the entire base components would be accessible.

FIGS. 14 and 15 illustrate views of scaffolding 160 which includes a scaffold board 162, usually a minimum of 12 inches in width, which is inserted into a first frame 164, having a single swivel leg 166, which allows the scaffold to be safely and temporarily secured out of the immediate work area of the well bore when not needed, secured to the base plate 14. The frame 164 would include a support frame 168, having an opening 170 for inserting the board 162 therethrough. The second end of the board would be inserted into a second frame 171, which would include a pair of legs 172, a support frame 170, and an opening 174 for inserting the board 162 therethrough. The second frame 171 would allow to tilt at an angle so as to engage the board 162 securely in place while the operators are standing thereupon to operate the upper tong in a casing running mode, the dual or multiple string completion operation. As illustrated, the frames 164 and 170 are height adjustable.

Figure 18:
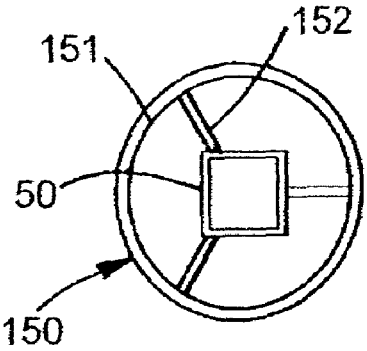
FIGS. 16 through 18 illustrate a protective cover for the forward shock attachment arm assembly.
Figure 16:
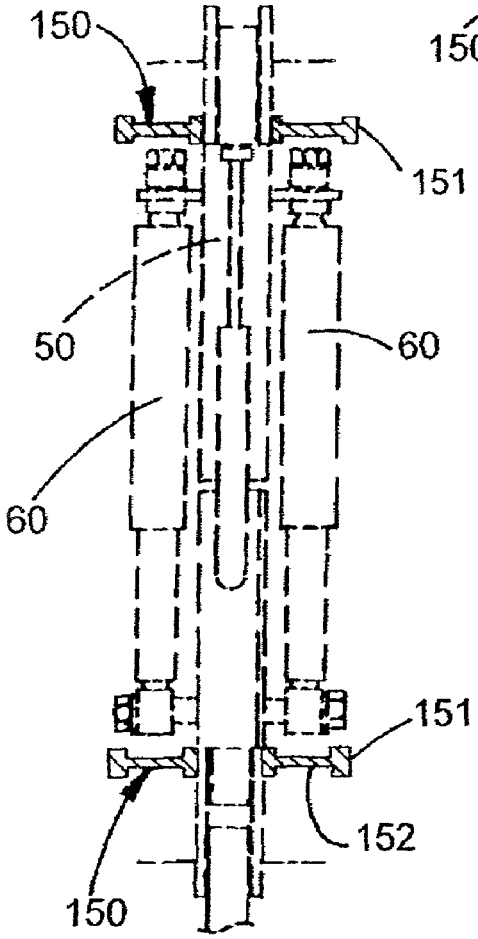
Figure 17:
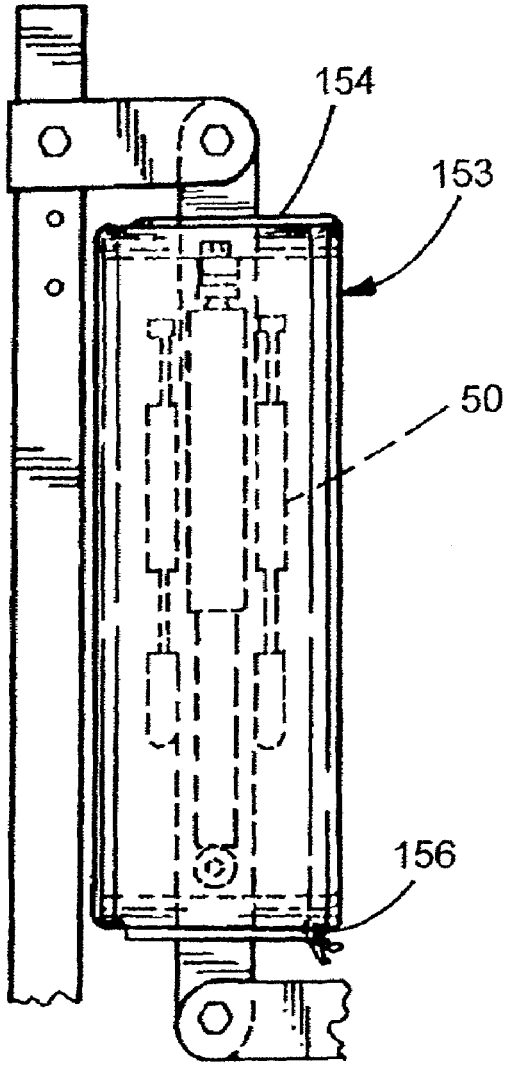
Figure 19:
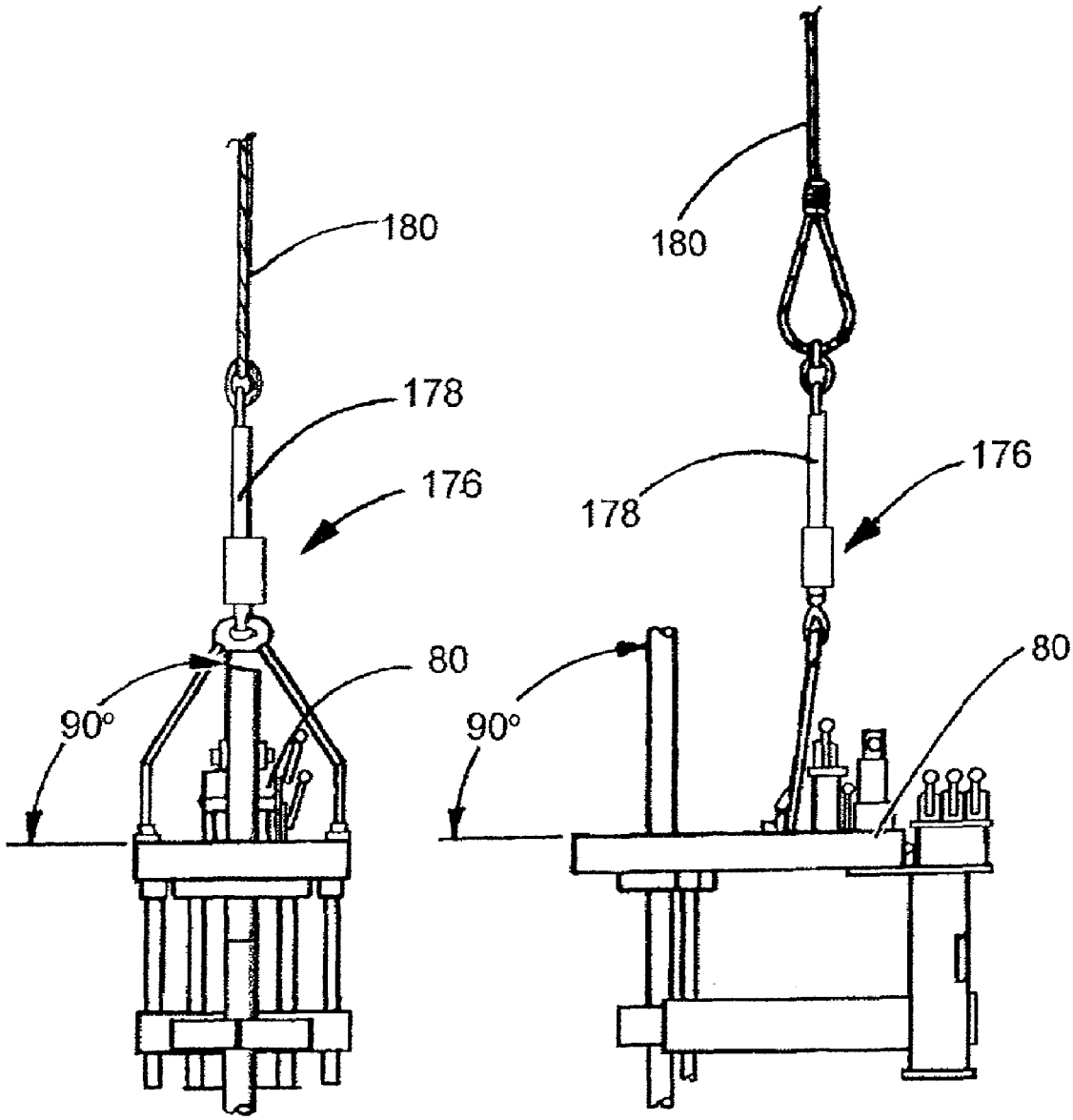
FIG. 19 (PRIOR ART)
FIG. 19 illustrates a lift system for a power tong, known in the art and labeled as "Prior Art;"
Figure 20:
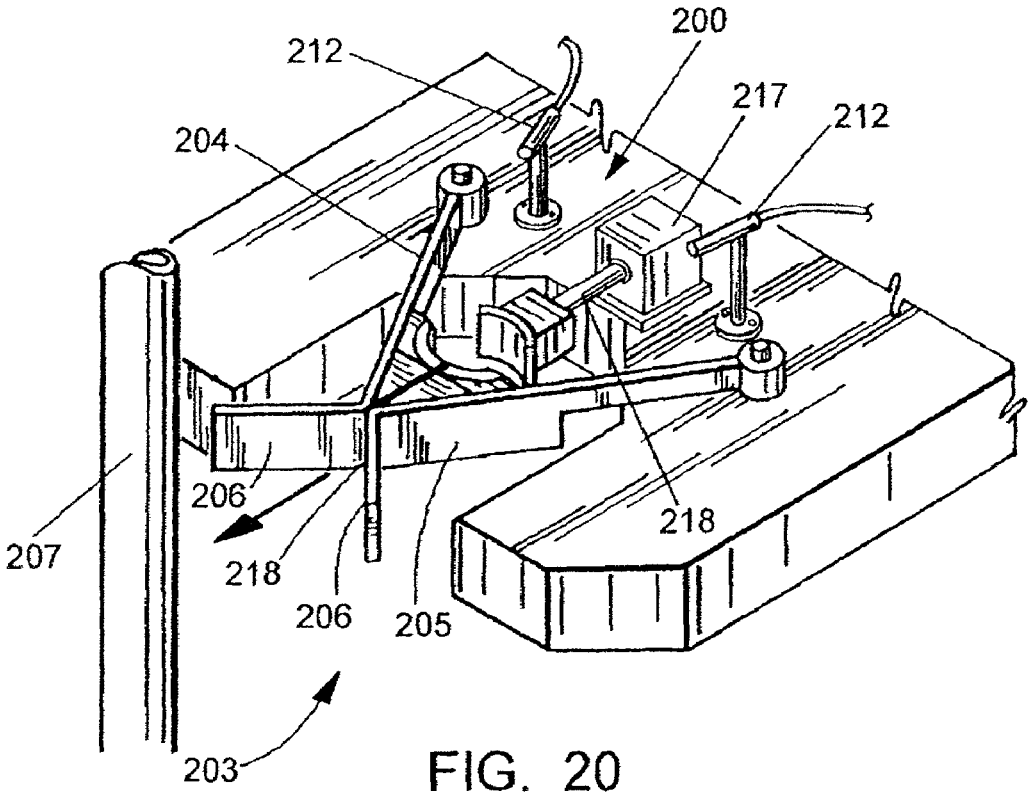
FIG. 20 illustrates an isolated view of the lower tong portion of the present invention.

FIGS. 16 through 18 illustrate yet another protective device for the apparatus. As illustrated, the attachment arm 50 is illustrated in phantom view in FIG. 16. There is provided a plurality of support members 150 positioned above and below the cylinders 60 of the attachment arm 50. As seen in FIG. 17, and in cross section view in FIG. 18, there is provided a cover 153 which is enclosing the cylinders 60 and attachment arm 50, the cover 153 supported on its upper end 154 and lower end 156 by the circular support members 150, illustrated in FIG. 18. Each support member 150 would engage around the arm 50, and have a plurality of arms 152 radiating outward to support frame 151, which would support the cover 153. Therefore, when in use, the movement of the arm and cylinders is protected from the operator inadvertently making contact with the moving parts, and thus avoiding injury.

Figure 25:
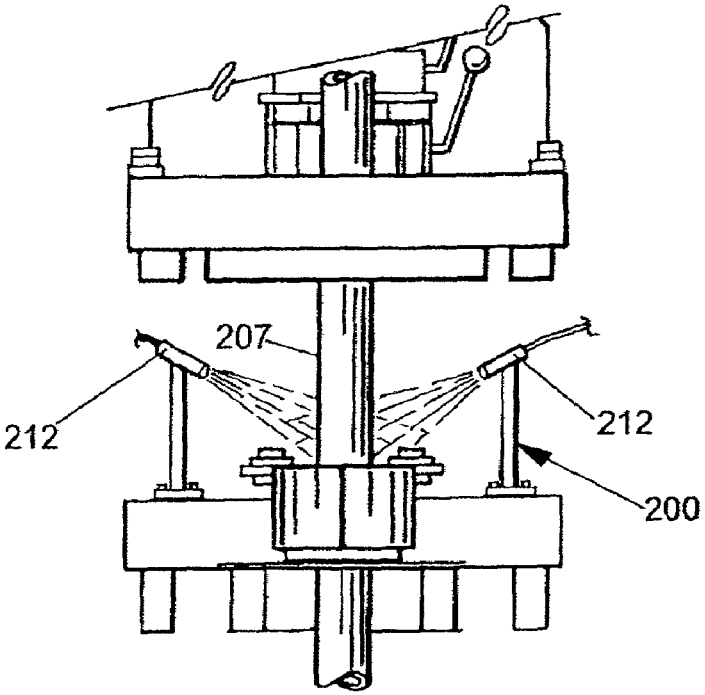
FIG. 25 illustrates a front view of the pipe guide and alignment system of the present invention with a pipe secured therein.
Figure 21:
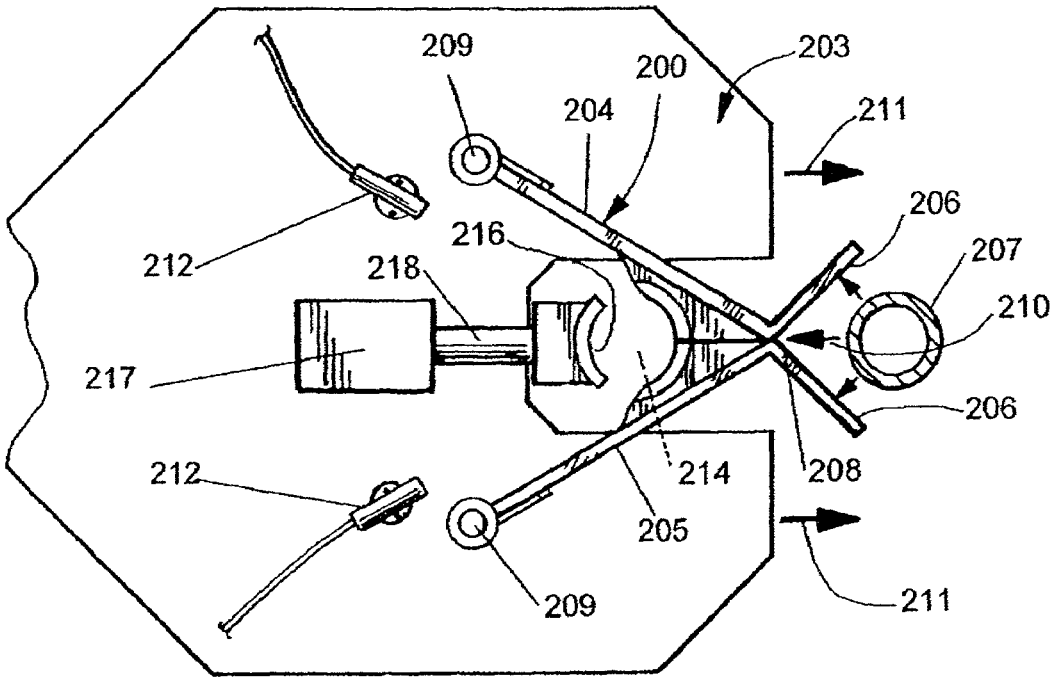
FIGS. 21 through 24 illustrate sequential top views of the pipe being engaged into the pipe guide and alignment system.
Figure 22:
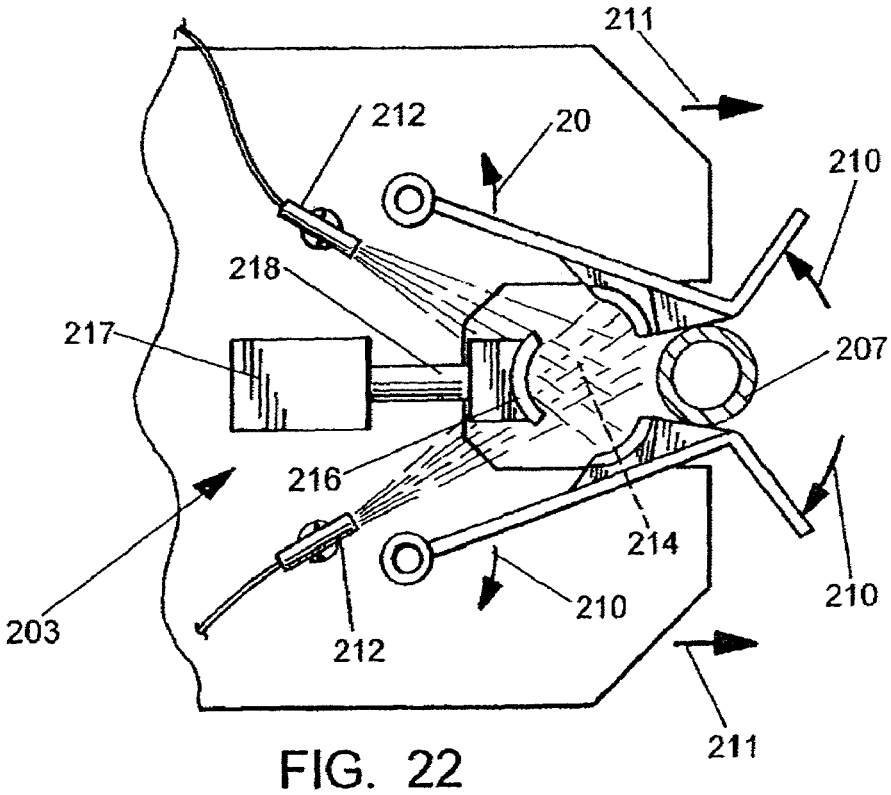
Figure 23:
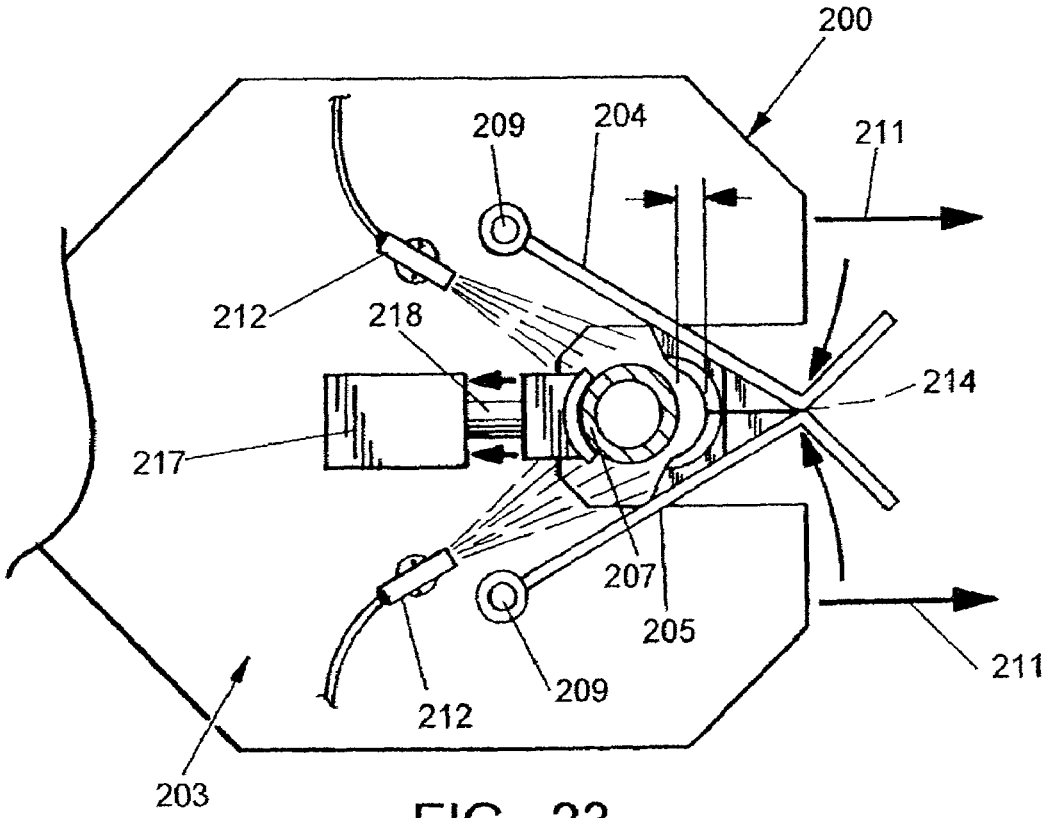
Figure 24:
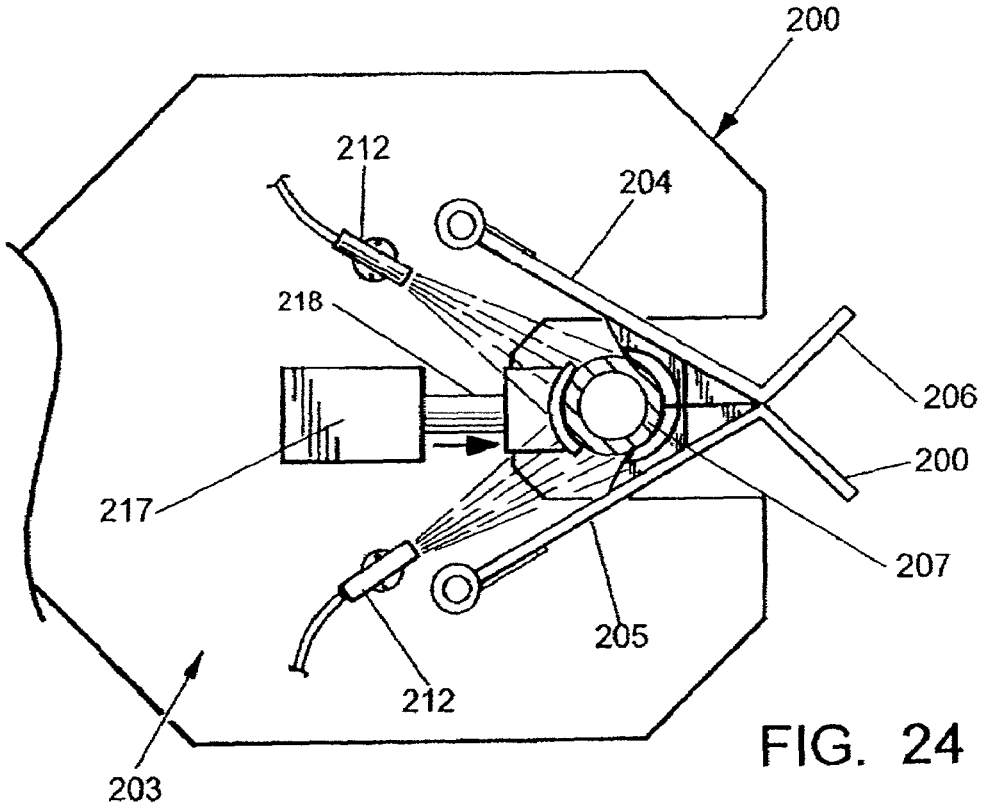
Figure 26:
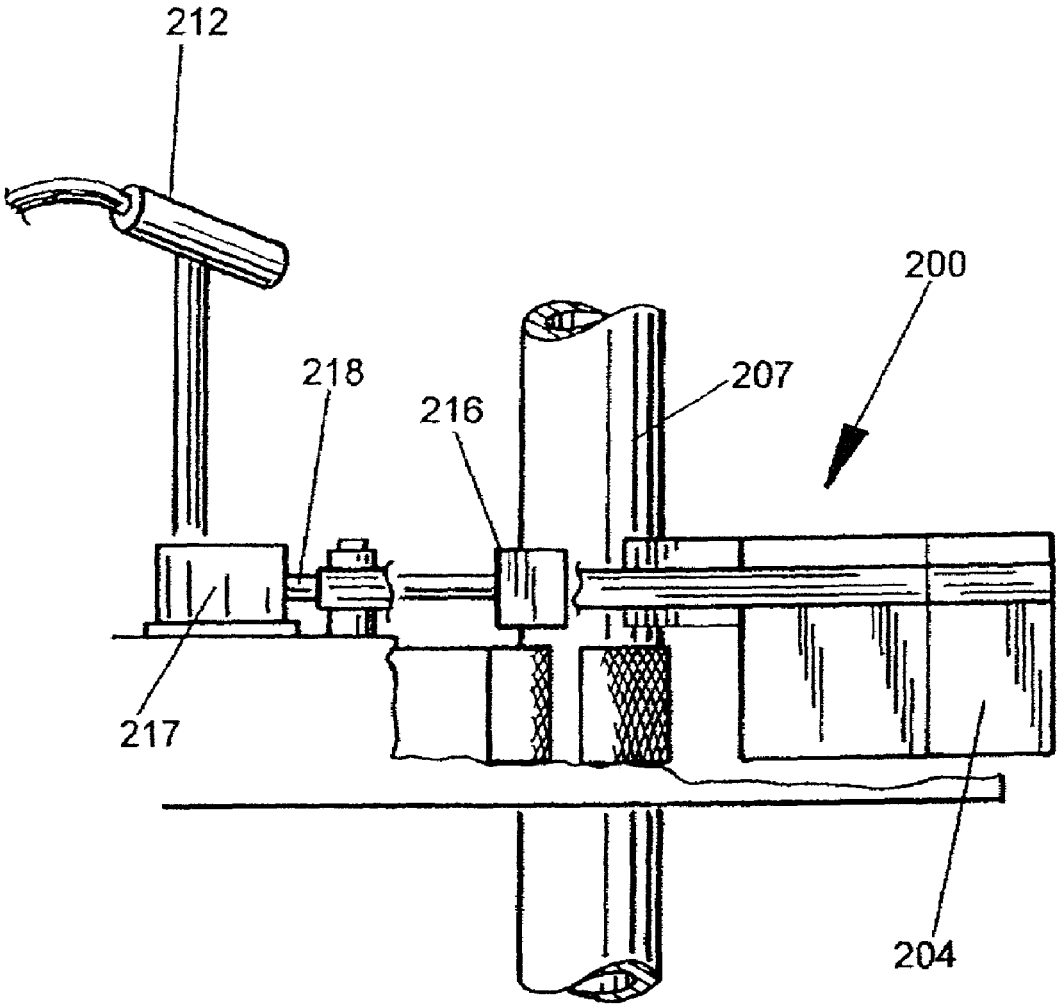
FIG. 26 illustrates a partial side view of a length of pipe secured within the pipe guide and alignment system.

FIGS. 20 through 26 illustrate various views of the pipe guide and alignment system utilized as part of the present invention by the numeral 200. The system 200 would include lower power tong section 203, which is seen in FIG. 21, arrows 211 showing system 200 moving in the direction of pipe 207 for beginning the process. System 200 would include a pair of guide an alignment arms 204, 205, which would be movable as a length of pipe 207 makes contact with the forward plate portions 206, and the apparatus is guided toward pipe 207, into point 208, as seen in top view in FIG. 21. As the guide arms 204, 205 are contacted by pipe 207, the arms pivot away at pivot points 209, and as seen in FIG. 22, the length of pipe 207 begins to ease into the gap formed between the guide arms 204, 205 as the forward plates 206 begin moving in direction of arrows 210. While this is taking place, reference is made to the pair of cameras 212, which have begun to record the process which is taking place while the pipe 207 into the guide and alignment system. Turning now to FIG. 23, at this point, the pipe 207 has entered into the space 214 defined by the guide arms 204, 205, and the rear alignment pad 216, which extends from the alignment device 217. As the length of pipe 207 moves into space 214, the pipe 207 makes contact with the rear alignment pad 216, at which point the pad 216, affixed to arm 218 extending from device 217, moves rearward to absorb the contact of the pipe 207 against the pad 216, which results in no damage to the pipe wall. In FIG. 24, the pipe 207 is now within space 214, and the alignment arm 218 returns to its position to engage the pipe 207 between the pad 216 and the alignment arms 204, 205. It should be noted that each of the alignment arms 204, 205 each include a guide pad 220, which when the arms are re-engaged, as seen in FIG. 24, the guide pads 220 of the guide arms 204, 205 and the rear pad 216 have the pipe fully engaged for operation. In FIGS. 25 and 26, there is illustrated in full side view and in partial side view, respectively, the lower tong section 203, with a length of pipe 207 engaged therein, and the cameras 212 recording the action. As will be more fully explained below, the cameras 212 are intrinsically safe, explosion proof cameras, and are utilized so that a worker or operator may be undertaking the complete operation as described above from a remote location, while viewing the entire operation in detail, and would not be near the work site which would reduce the chance of accidents. Of course, at any time the operator, if viewing any improper operation, could shut down the tong operation from his remote location.

In conclusion, in the preferred embodiment of the system described above in reference FIGS. 1 through 18 and 20 through 26, the following points should be reiterated.

The utilization of three pivotal points is not limited in this configuration but may include fewer or more pivotal points in the application. The present invention has three basic components which include the base with the rear and forward support elements. The rear support would have a minimal of three pivotal points as was discussed, the lower most pivotal point at a minimum of four degrees, in part to prevent locking of the two pivotally connecting members; on the one part the drive cylinder, and secondly, the pivotal moment arm. Further it allows the drive cylinder to advance or retract the optimum distance with least resistance or restriction in relation to the base. The forward support would have a minimum of three pivotal points at approximately four degrees, partly to prevent locking of the two pivotally connecting members, on the one part the drive cylinder and secondly, the pivotal moment arm; and further to allow the drive cylinder to advance or retract the optimum distance with least resistance or restriction; and further in relation to the pivotal connection of the cylinder in relation to the horizontal base and the vertical rear support when attached to the forward moment arm in pivotal relation with the drive cylinder or forward attachment arm. There may be included a hydraulic limiting switch, cell or in-line valve which is utilized to prevent excessive flow of hydraulic fluid into and out of the cylinder 24.

The second component would be the frame and cover, as was discussed in relation to FIGS. 13-15, which may be a metal retractable design or a flexible industrial grade material which may be also suitable.

The third component or the power drive would be designed whereby a hydraulic cylinder/air cylinder or other suitable driver as previously discussed activates the pivotal moment arm attached to the shock absorbing tool downwardly at approximately four degrees in part to prevent locking of the two connecting members and further to allow the drive cylinder to advance or retract the optimum distance with least resistance or restriction and toward the forward support. The power source may be diesel driven or otherwise, forced air pressure, electronic signaling with sender and receiver or other similar power source. The power driver may be diesel driven hydraulics, other hydraulics, forced air pressure or electronic signaling with sender and receiver. The cylinder may be hydraulic or air cylinder. Additional power source may utilize a cam over action utilizing belt, chain or similar device or there may even be a rail system advanced by a chain drive rather than utilizing the hydraulic cylinder.

In the points to be made about the power drive applicant would make the following points:

Moment Arm Attachment is lower rear pivotally attached to cylinder with a cushion or shock type device at a minimum 4-degree deviation relative to the horizontal base.

Forward Shock Attachment Arm connected rear to the Forward Pivot Point on the Moment Arm which connects pivotally on the forward support member at one of three minimum pivotal points on the Moment arm.

The forward pivotal point of the Moment Arm is designed whereby the Attachment Arm is secured at a pivotal point whereby when the Apparatus is in a delivery or storage mode, the Forward Attachment Arm is secured in a vertical position while remaining connected with the Moment Arm.

The Tong Frame Attachment Point pivotally connects both vertically and horizontally to the Forward Attachment Shock. The Shock Apparatus is designed such as to limit sudden jerking motion both vertically and horizontally.

The design of this apparatus is such that a prior art vertical positioning apparatus 176 as seen in FIG. 19 of the prior art, the hydraulic cylinder 178 connecting on one upper end to the rig cable 180 and to the lower end the power tong 80 may be utilized in combination with the apparatus.

Further to this invention, as was referred to and described in FIGS. 20 through 26, as the power tong engages each pipe section to be screwed together, this invention utilizes the pipe guide and alignment system 200, which includes the optical features, that includes the lower tong or (back-up tong) be equipped with tubular guide plates vertically aligned on each side of the opening of the lower tong whereby the upper and lower tong easily mates with each tubular or pipe section prior to make up. The tubular tong guide is connected to the lower tong by 1 inch (2.54 centimeter) square tubing or the like to the rear and to each side of the lower tong throat by ¾ inch (1.91 centimeter) threaded bolts, each comprising a spacer with swivel capability, with a lock washer and threaded nut to hold the alignment guide system in place. The system is designed specially to be utilized with chrome tubulars and is further specially coated to minimize damage to the chrome tubular while putting the tong in place on each tubular section prior to makeup.

This invention specifically utilized the tubular guide system attached to the lower forward section of the power tong but secured to each side and to the rear of the lower tong throat which receives the tubular section and protrudes forward and downward of the lower tong to guide the pipe section into the jawed lower tong throat area and is an integral part of the Optical Guide and Alignment System.

Further to the Optical Guide and Alignment System and designed and attached thereto, tong door controls are used as the tong and backup are readied for makeup, the tong operator utilizes and functions the (automatic air) controls from his normal operating position for the opening and closing of the forward door of the tong which eliminates any contact by the rig crew with moving parts which may cause injury to those rig crew members not knowledgeable with such technology.

An alternative to the above, the apparatus is designed to be remotely operated with said remote controls functioning as a result of hydraulic, air, air over hydraulics, electronic power, for example, equipment developed by Hydraquip to remotely control an oil well completion frac unit for Petrotool Company. Remote operation in this instance includes but in not limited to control of the tong positioning system by the tong operator but may also include operation by the driller who controls the drawworks while pulling and running of the tubulars and additionally has full responsibility for all other activities while on the rig floor.

Further as a means of visual acuity, with intrinsically safe cameras mounted in such position and location that (such) close visual may be observed are positioned opposing intrinsically safe video cameras for digitally recording the address and makeup of the threaded pipe connection with the idea of eliminating potential problems before the Tubular is run down hole. By utilizing video cameras, monitors may be placed in strategic locations such as on the tong whereby the tong operator may respond immediately to any adverse condition regarding the makeup of one pipe section to another pipe section or in the rig supervisor's office for immediate feedback and further a digital or VHS recording is made and is available for evaluation should a problem be identified later during the completion process. For example, during a wire line procedure, the wire line tool may become stuck inside a pipe section and will not go downhole which may indicate crimped pipe. Crimped pipe may be a result of improper alignment of one pipe section to another pipe section causing crossed threading, improper torque applied by the tong or the upper tong or lower tong back up gripping the pipe section improperly.

Further to the positioning of the tong on each chrome tubulars, there may be mounted on the lower tong electronic/hydraulic alignment (positioning) pads that determine the predisposition of each tubular section prior to screwing together to assure that the threaded body is properly aligned and will not cross thread, show a bad torque turn graph or gall while connecting sections together.

The positioning pads are designed relative to the vertical positioning and orientation of each Tubular in relation to the jaw/die on the upper tong and/or jaw/die lower tong configuration. This positioning and alignment is critical to eliminate damage to the chrome tubular once the Tong is energized and the jaw/die makes contact with the Chrome Tubular section.

Most chrome tubular sections with premium connections are made up utilizing a torque turn system with a electronic dump which prevents over torque that may result in bulging or deformity of the connection. Connection Technology Inc. of Belle Chasse, La. sells one Torque Turn System.

Further, the positioning pad most rear to the centering positioning of the tubular section in the well bore shall be so designed as to have a padded shock-absorbing propensity or cushion effect on the chrome tubular to prevent damage as each tubular section is positioned for makeup.

Further to the above tong positioning apparatus which utilizes the standard Rig provided cable as seen in the prior art FIG. 19, to support the prior art lift/positioning cylinder, another method to handle the tong or other such heavy items on the rig floor is to utilize the stand alone hydraulic system. This tong positioner shall be free standing and fully support the tong; however, this tong positioning apparatus is designed to be utilized in larger deepwater applications. The apparatus is designed to function as a 'stand alone' tong positioner, utilizing some characteristics as incorporated in a rig mounted crane with swivel mounted base for multi-directional utilization.

Figure 27:
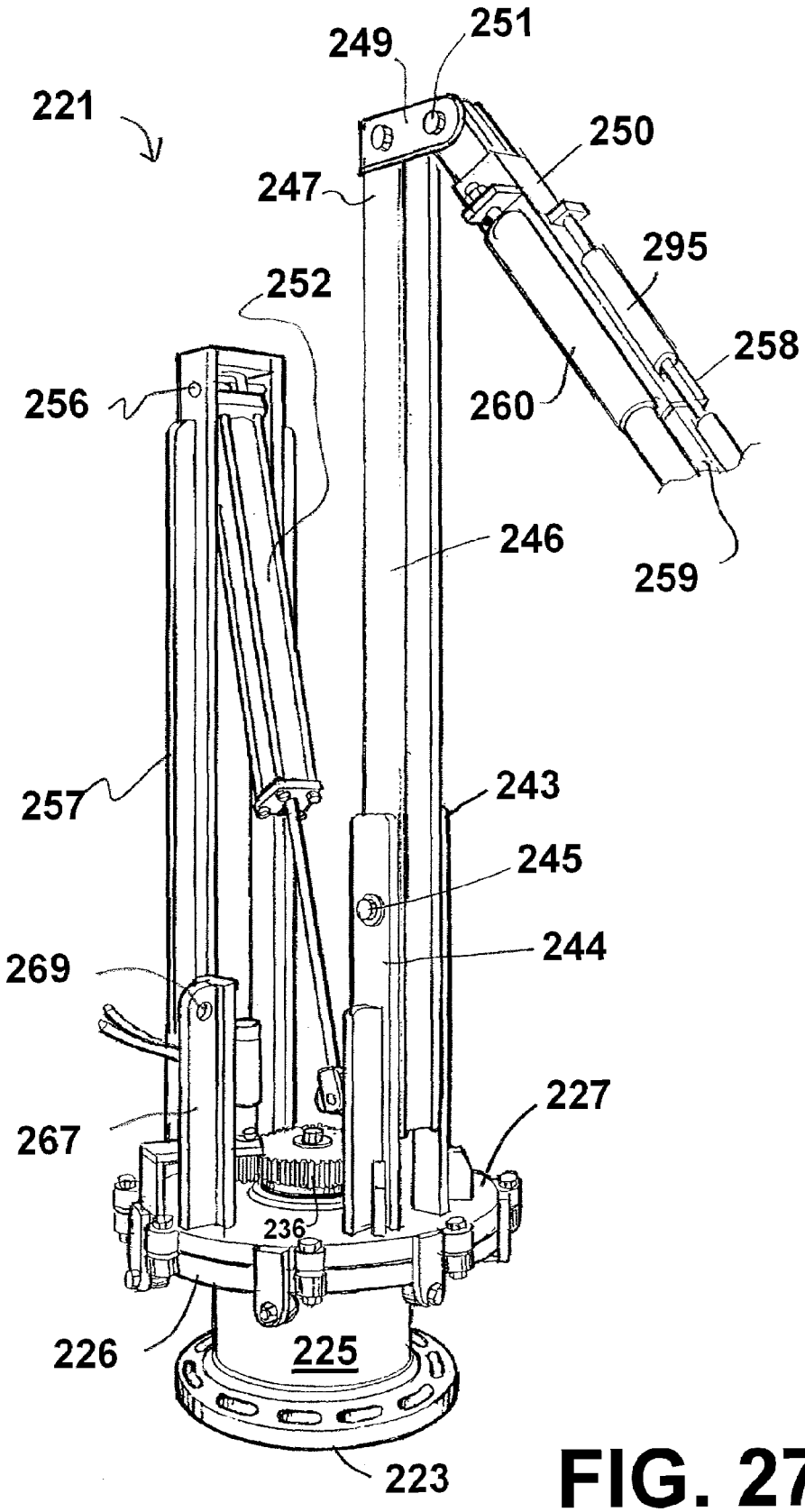
FIG. 27 is a perspective view of a second embodiment of the apparatus of the present invention.
Figure 28:
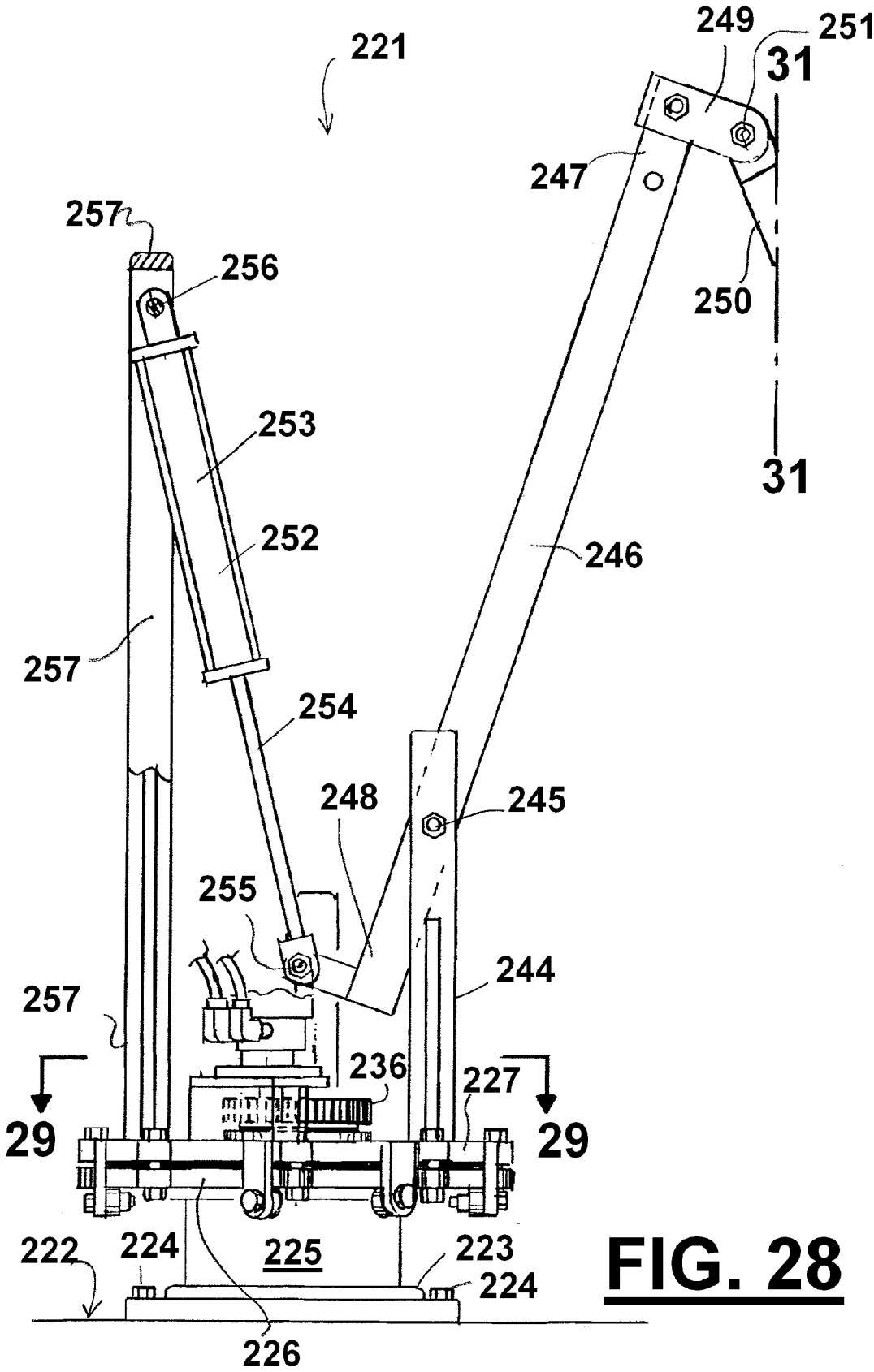
FIG. 28 is an elevation view of the second embodiment of the apparatus of the present invention.

FIGS. 27-37 show a second embodiment of the apparatus of the present invention designated generally by the numeral 221. Tong positioning apparatus 221 can be mounted in a selected location such as upon a well drilling rig floor 222. Tong positioning apparatus 221 has a lower base 223 that can be affixed to a rig floor 222 or other underlying support surface using for example bolted connections 224. Pedestal 225 can be generally cylindrically shaped and extends upwardly from base 223 as shown in FIGS. 27 and 28. Pedestal 225 supports lower plate 226 which is affixed to pedestal 225, for example by welding. Upper plate 227 rotates relative to lower plate 226. A generally frictionless bearing layer 228 (e.g. Teflon®) can be placed in between lower plate 226 and upper plate 227.

Figure 29:
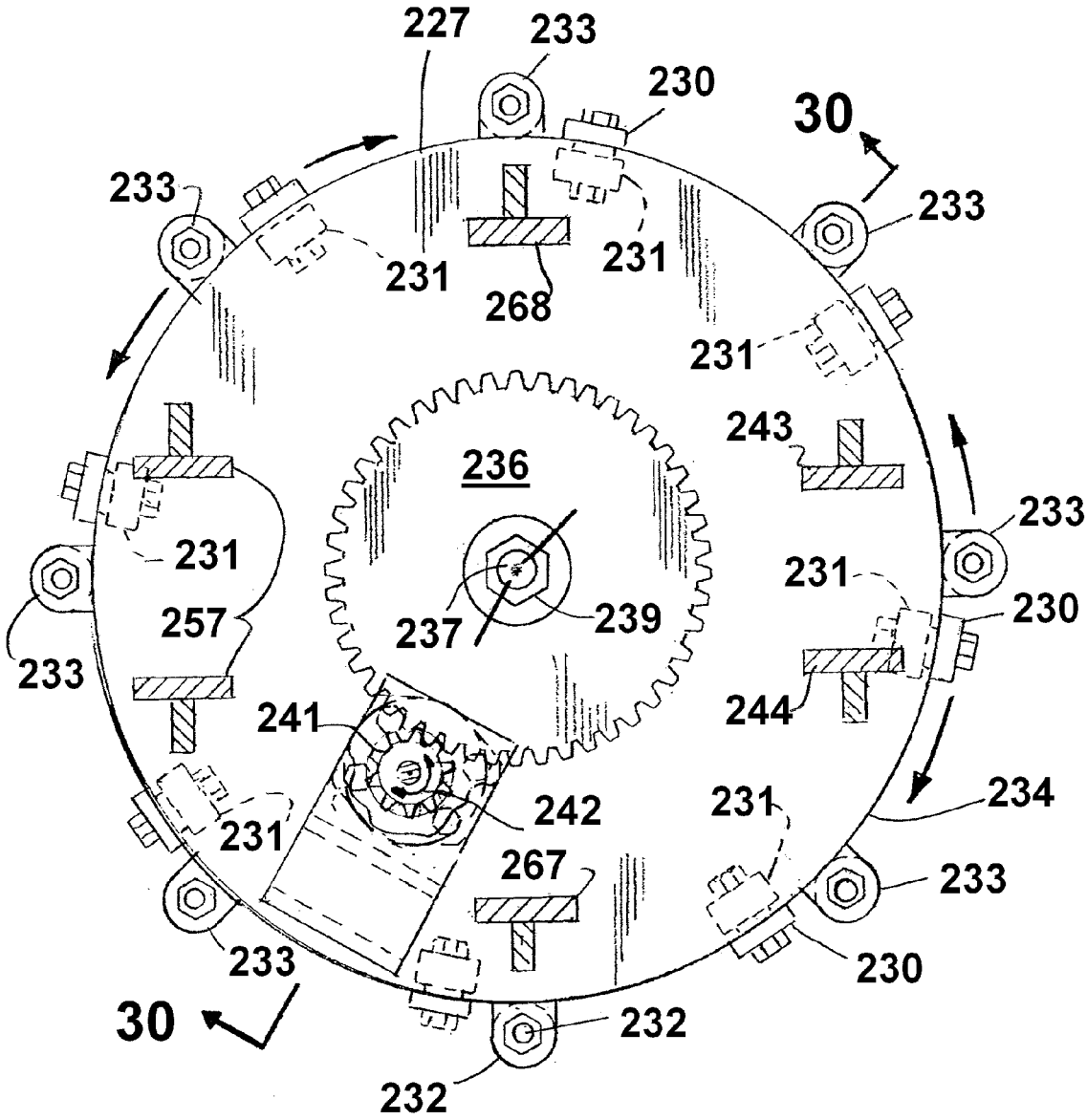
FIG. 29 is a sectional view taken along lines 29-29 of FIG. 28.
Figure 30:
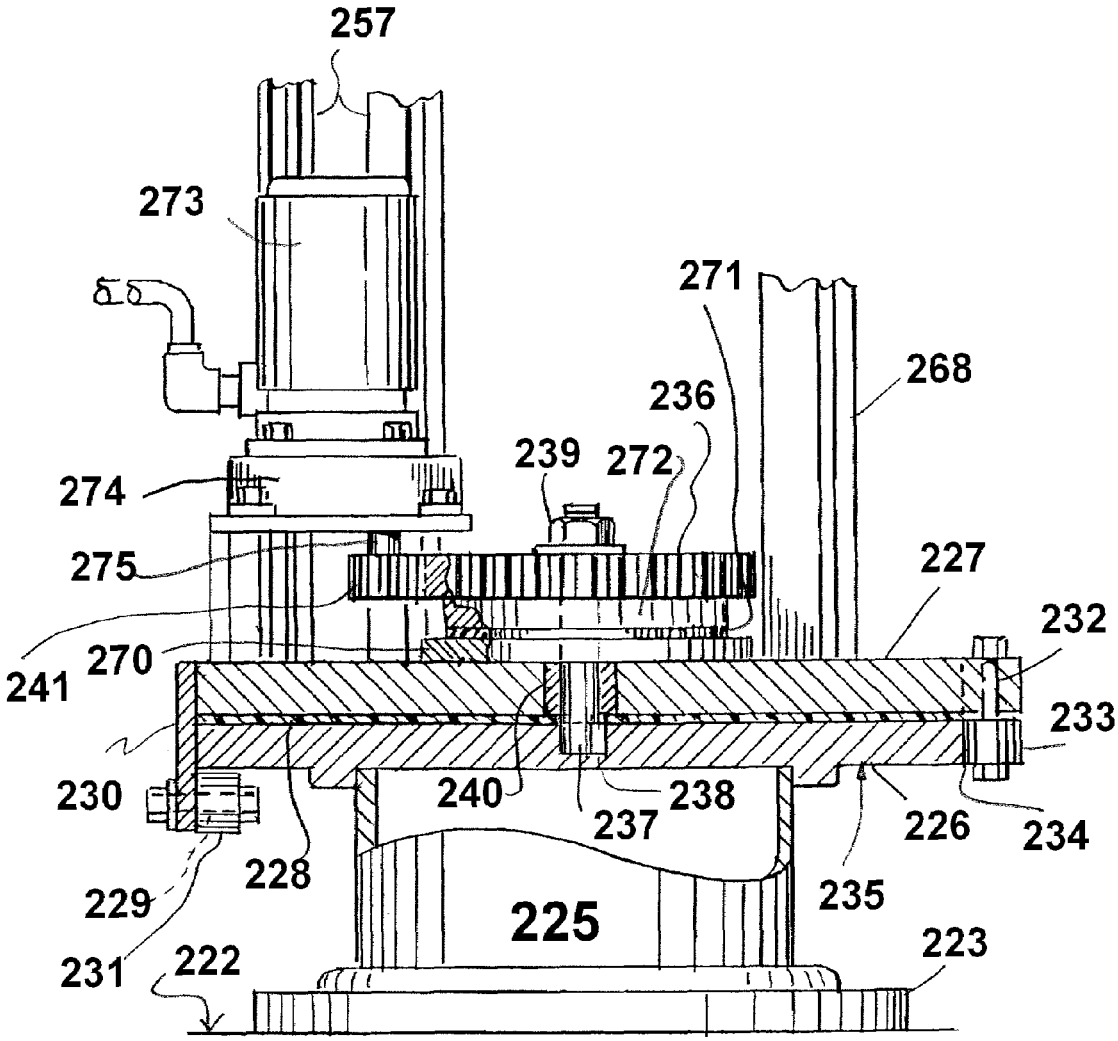
FIG. 30 is a sectional view taken along lines 30-30 of FIG. 29.
Figure 31:
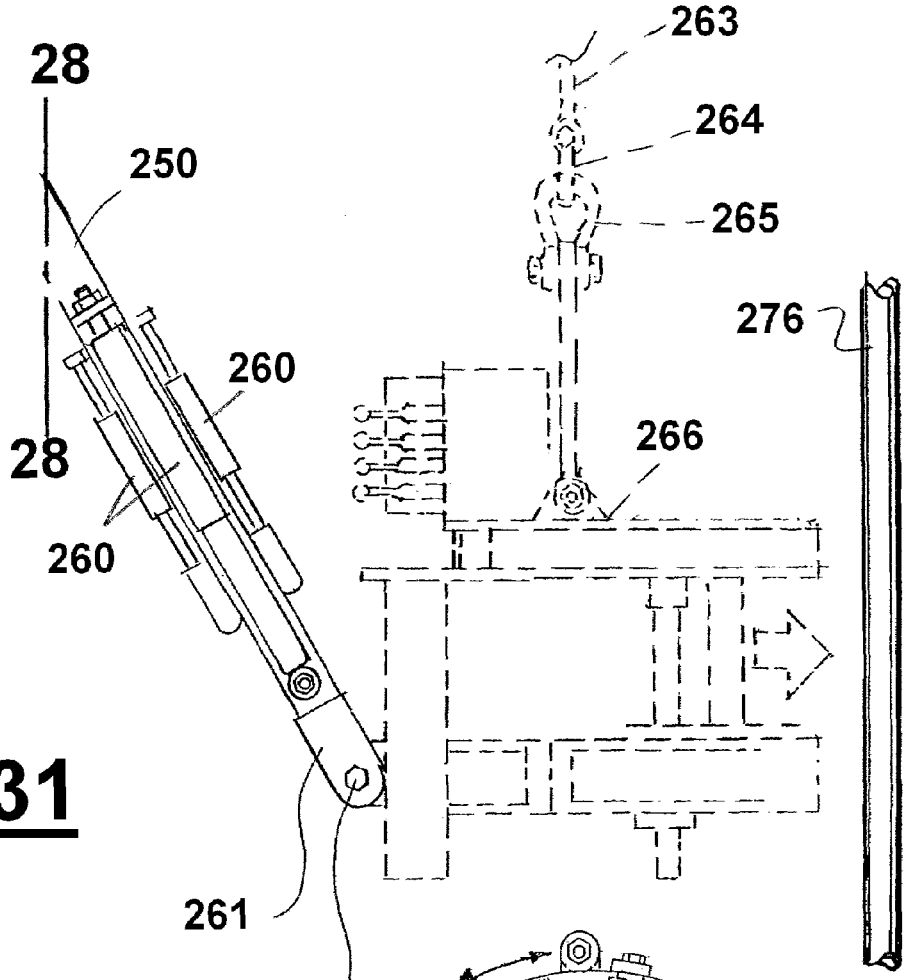
FIG. 31 is a fragmentary elevation view of the second embodiment of the apparatus of the present invention.

In FIGS. 29 and 30, a plurality of rollers 231, 233 can be provided for maintaining alignment of the plates 226, 227. In that regard, a plurality of vertical plates 230 can be attached to upper plate 227 as shown in FIGS. 29 and 30. Horizontal shaft 229 is attached to plate 230 and supports roller 231. Each roller 231 engages the under surface 235 of lower plate 226. A plurality of vertical shafts 232 can be attached to the periphery of upper plate 227 as shown for example in FIG. 4. Each roller 233 engages the periphery 234 of lower plate 226. Each roller 233 is mounted upon vertical shaft 232.

A motor drive and gear arrangement can be used to rotate upper plate 227 relative to lower plate 226. In FIGS. 27-30, the motor drive and gear arrangement can provide a hydraulic motor 273, gear box 274, and gear 241. The gear 241 is a smaller gear that engages larger gear 236. The larger gear 236 can provide a plate with shoulder 272. Plate with shoulder 272 is mounted upon bearing layer 271. The bearing layer 271 is mounted upon spacer plate 270 that extends upwardly from plate 227 as shown in FIG. 30. Shaft 275 extends downwardly from gear box 274 and attaches gear 241 to gear box 274.

A vertical shaft 237 is attached to lower plate 226 using key 238. Gear 236 rotates with respect to shaft 237. Bolt 239 secures gear 236 to shaft 237 as shown in FIG. 4. A sleeve 240 can be provided as a bearing in between rotating plate 227 and shaft 237 as shown in FIG. 30. Arrow 242 in FIG. 29 shows that when gear 241 rotates, it also rotates gear 236 and plate 227.

Columns 243, 244 support intermediate member 246. Intermediate member 246 is mounted to columns 243,244 using pivotal connection 245. The intermediate member 246 has an upper end portion 247 and a lower end portion 248. At the upper end portion 247, a link 249 enables a pivotal connection at 251 to be formed with forward member 250.

Hydraulic cylinder 252 has end portions that connect to forward member 246 at pivotal or pinned connection 255 and to column 257 at pinned or pivotal connection 256. The hydraulic cylinder 252 includes a cylinder 253 and pushrod 254. As the hydraulic cylinder expands or contracts, the pinned connection 255 moves toward or away from cylinder 253 thus rotating intermediate member 246 relative to pinned connection 245. This action either lowers and projects forward, or elevates and retracts forward—the member 250. In FIG. 27, forward member 250 is elevated to its maximum position when hydraulic cylinder 252 is fully expanded as shown.

Figure 38:
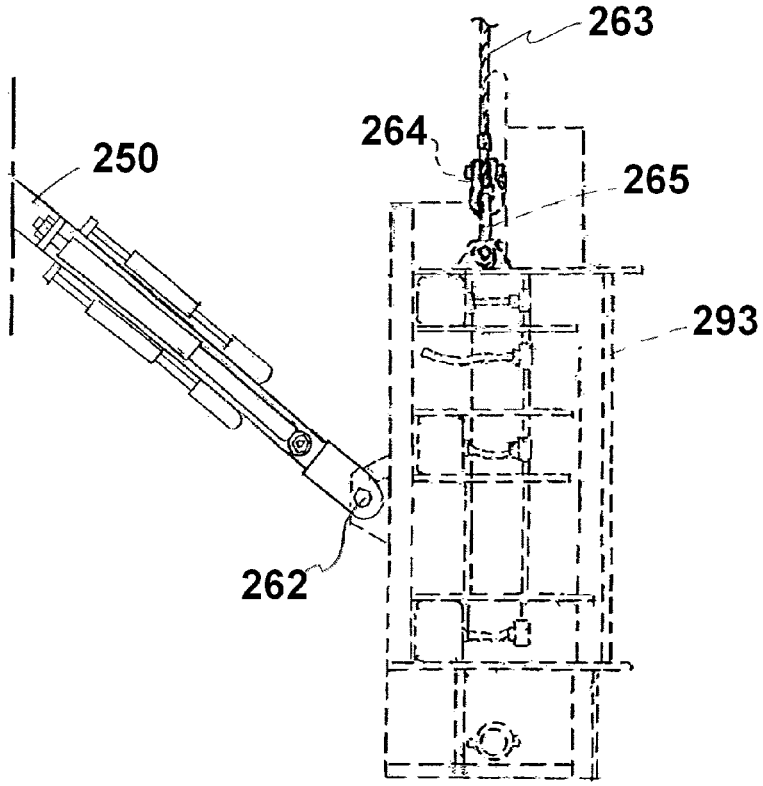
FIG. 38 is a fragmentary elevation view of the second embodiment of the apparatus of the present invention showing the supporting of a mud bucket.
Figure 39:
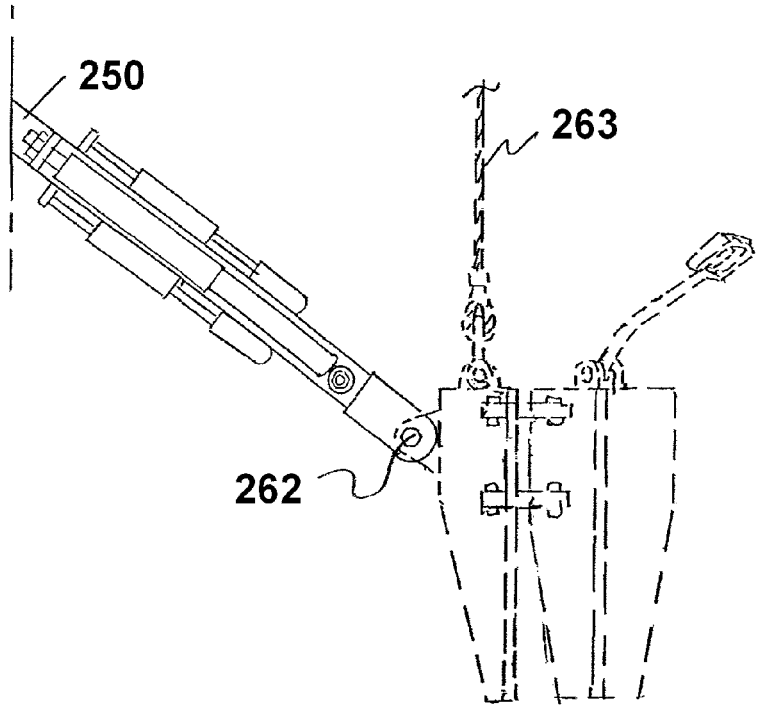
FIG. 39 is a fragmentary elevation view of the second embodiment of the apparatus of the present invention showing the supporting of a set of slips.

Forward member 250 is a telescoping member that includes upper section 258 and lower section 259. A pair of shock absorbers 260 can be attached at end portions to upper section 258 and lower section 259 respectively (see FIGS. 36, 37). Forward member 250 provides a lower end portion 261 that can be attached at pivotal connection or pinned connection 262 to an item to be lifted such as the power tong 266 shown in FIG. 31, the mud bucket 293 shown in FIG. 38, or the slips 294 shown in FIG. 39. Guides 295 can also be affixed respectively to upper section 258 and lower section 259 of forward member 250 to help maintain alignment of the sections 258, 259 in combination with the shock absorbers 260.

When handling a power tong 266, mud bucket 293, slips 294, or other item (see FIGS. 38, 39), a crane lifting line 263 is employed that provides a lifting implement such as a hook 264 or shackle for attaching to an additional shackle 265 or other rigging for forming an interface between the item to be lifted 266, 293, 294 and the crane lifting line 263.

The apparatus 221 of the present invention can be lifted using columns 267, 268 each of which is provided with an opening 269. In this fashion, a lifting device such as a crane can be attached to the column or columns 267, 268 at opening 269 using a shackle or other rigging.

Figure 32:
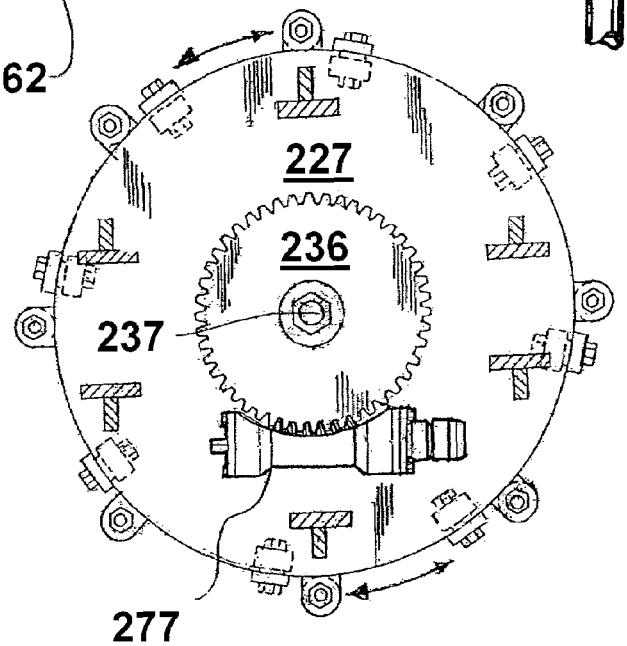
FIG. 32 is a sectional view of the second embodiment of the apparatus of the present invention, taken along lines 29-29 of FIG. 28 and illustrating an alternate rotating device in the form of a worm gear arrangement.

FIG. 32 illustrates that a different type of motor drive arrangement could be used for rotating gear 236. In FIG. 32 for example a worm gear motor drive 277 is shown engaging gear 236. Operation of the worm gear motor drive 277 rotates gear 236 and plate 227.

Figure 33:
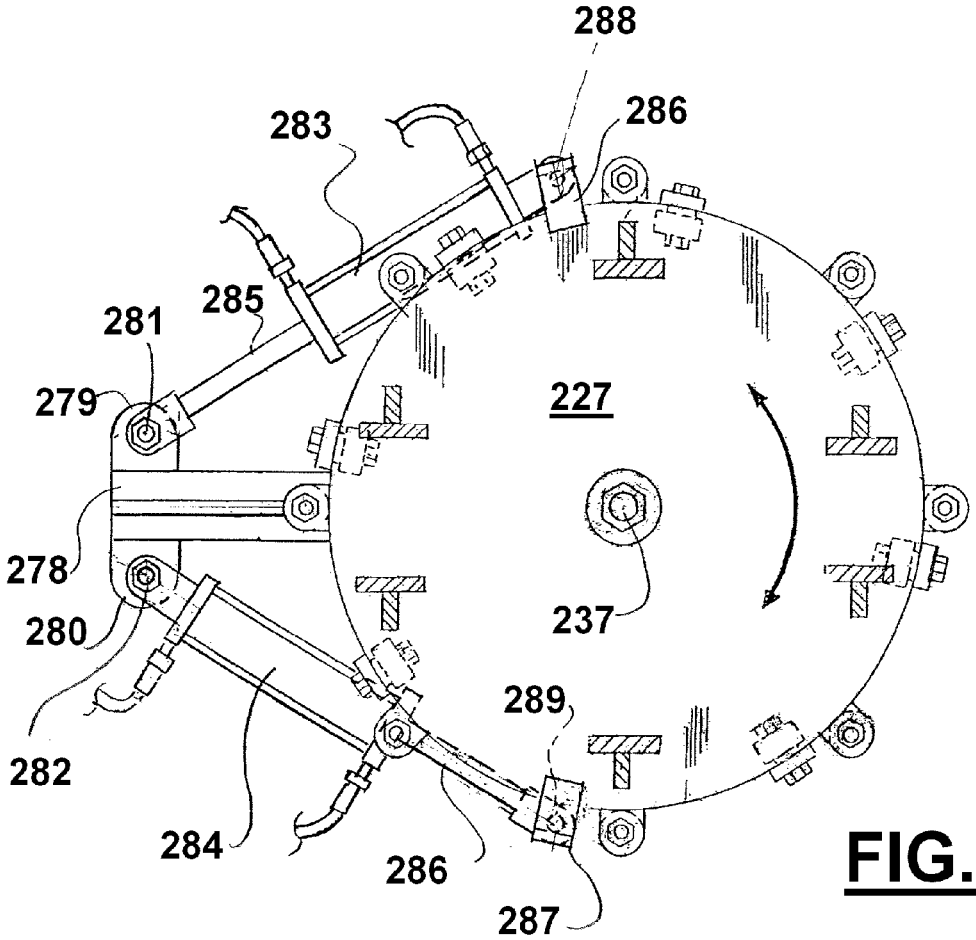
FIG. 33 is a partial sectional view of the second embodiment of the apparatus of the present invention, and illustrating an alternate rotating mechanism in the form of two angularly oriented hydraulic cylinders.
Figure 34:
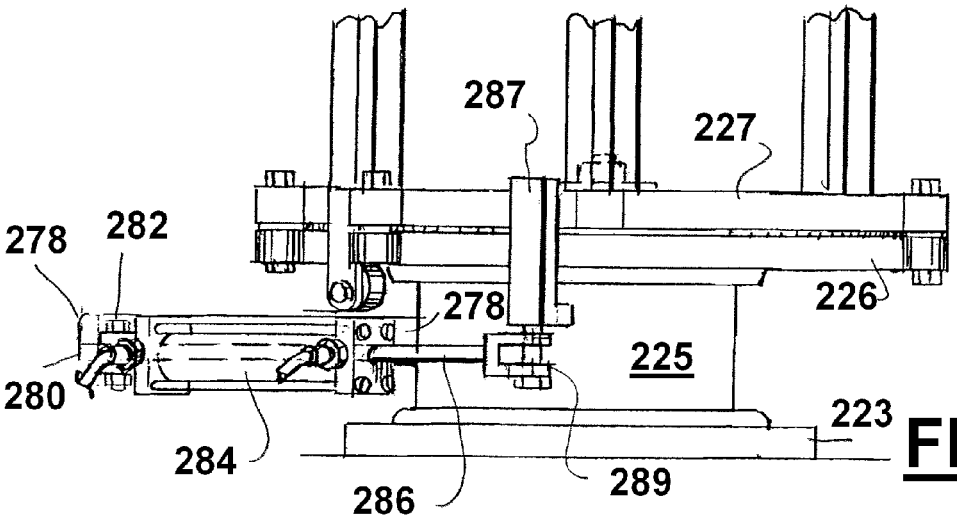
FIG. 34 is a side view of the hydraulic cylinder arrangement of FIG. 33.
Figure 35:
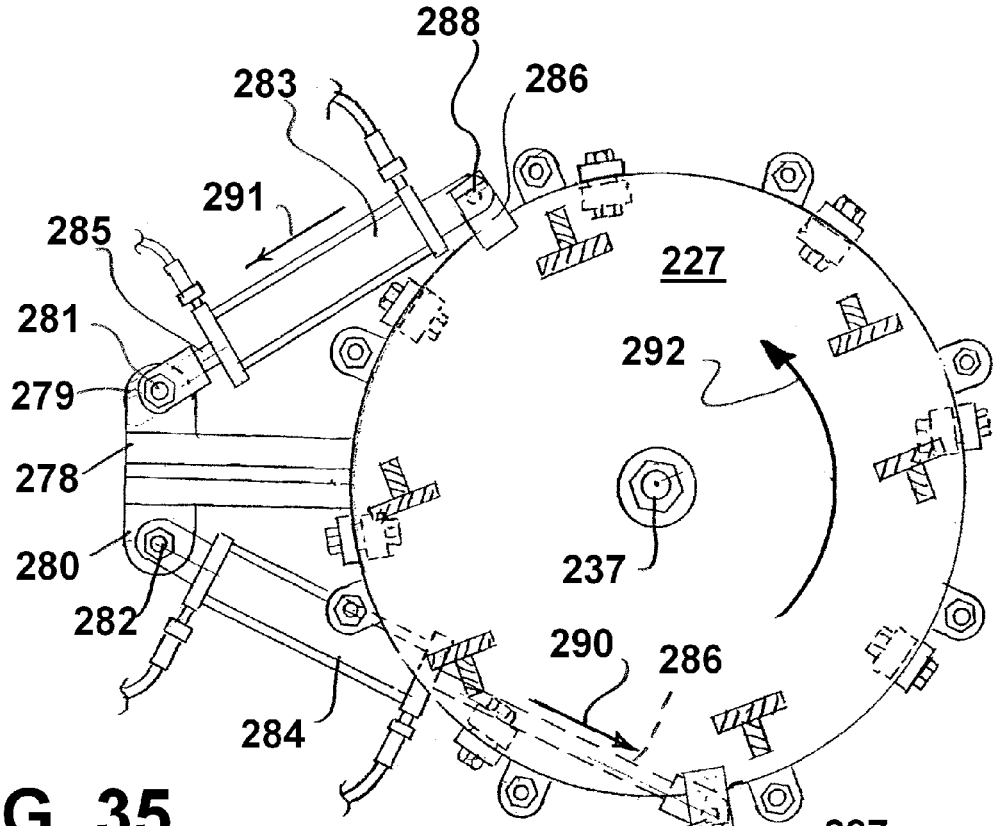
FIG. 35 is a plan, sectional view showing the hydraulic cylinder arrangement of FIGS. 33 and 34 wherein one cylinder has extended for rotation of the apparatus in a counterclockwise direction, the other cylinder having been retracted.
Figure 36:
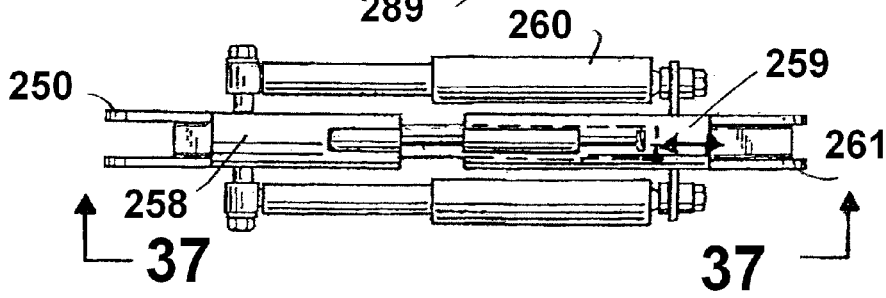
FIG. 36 is a fragmentary view of the preferred embodiment of the apparatus of the present invention.
Figure 37:
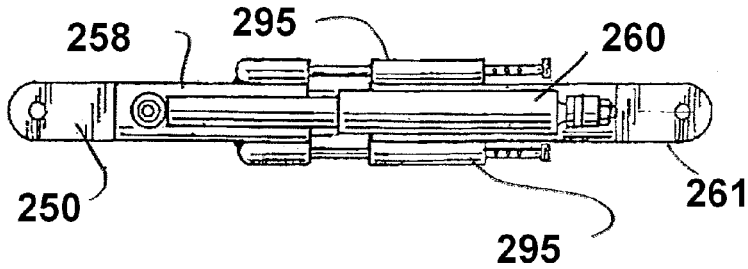
FIG. 37 is a sectional view taken along lines 37-37 of FIG. 36.

FIGS. 33-35 show yet another arrangement for rotating the plate 227 relative to the plate 226. In FIGS. 33-35, a cylinder support 278 is attached (for example, welded) to pedestal 225. The cylinder support 278 provides a pair of opposed lugs 279, 280. A pivotal connection is formed between each lug and a hydraulic cylinder. In FIGS. 33-35, hydraulic cylinder 283 is attached to lug 279 at pivotal connection 281. Hydraulic cylinder 284 is attached to lug 280 at pivotal connection 282. Each hydraulic cylinder provides a pushrod. Cylinder 283 provides pushrod 285. Cylinder 284 provides pushrod 286. Each pushrod attaches to plate 227 using a lug and pivotal connection. Pushrod 283 attaches to plate 227 at lug 286 using pivotal connection 288. Similarly, pushrod 284 attaches to plate 227 using lug 287 and pivotal connection 289. In FIG. 35, arrow 290 illustrates an expansion of hydraulic cylinder 284 so that its pushrod 286 assumes the fully extended position shown in FIG. 35. In FIG. 35, the cylinder 283 shows a fully retracted position wherein its pushrod 285 has been fully withdrawn, this combined action of the hydraulic cylinders 283, 284 effecting a rotation at plate 227 in the direction of arrow 292.

FIGS. 40-48 show a third embodiment of the apparatus of the present invention designated generally by the numeral 300 in FIGS. 40-43. Tong positioning device 300 is similar to the first and second embodiments in that it provides a tong positioning apparatus as shown and described in FIGS. 1-39, thus providing a forward shock attachment arm 50 with end 59 or a forward member 250 with lower end portion 261 and pivotal/pinned connection 262 (for example, see FIGS. 40, 41, 42, 43, 47).

Such an end portion 59, 261 is part of the apparatus shown in FIGS. 1-39. The tong positioning device 300 of FIGS. 40-48 can thus incorporate the base member 12, cylinder 22, forward upright support member 47, moment arm 40 and forward shock attachment arm 50 or 250 having second or lower end 59, 261 (as shown in FIGS. 1-26) and wherein the lower end 59 or 261 attaches at pivotal/pinned connection 262 to housing 317. The connection of FIG. 40 between the forward member 250 and the housing 317 can be the same connection designated as point 72 in FIGS. 1, 2A-2B and 3.

Tong 266 can be supported with line 263, shackles 265 or other suitable lifting/rigging equipment.

Power tong 266 is shown in FIGS. 40-43 connecting to an upper section of drill pipe tubular 276 that is to be rotated in a similar fashion as described in the embodiments of FIGS. 1-39. However, power tong 266 in this embodiment will not also simultaneously connect to a lower section of drill pipe tubular. Accordingly, where power tong 266 applies a rotational torque on upper section of drill pipe tubular 276, an equal but opposite reaction torque will be applied by tubular 276 on power tong 266 which reaction torque can be passed through to arm 250 through lower end 261 if not accounted for. Such passing through of the reaction torque will likely damage arm 250. In this embodiment, as will be described below, power tong 266 can be set up so that it rotationally floats in a substantially horizontal plane relative to arm 250 (at least until snub line 303 becomes taut and resists the reaction torque so that such torque is not passed through to arm 250).

Figure 42:
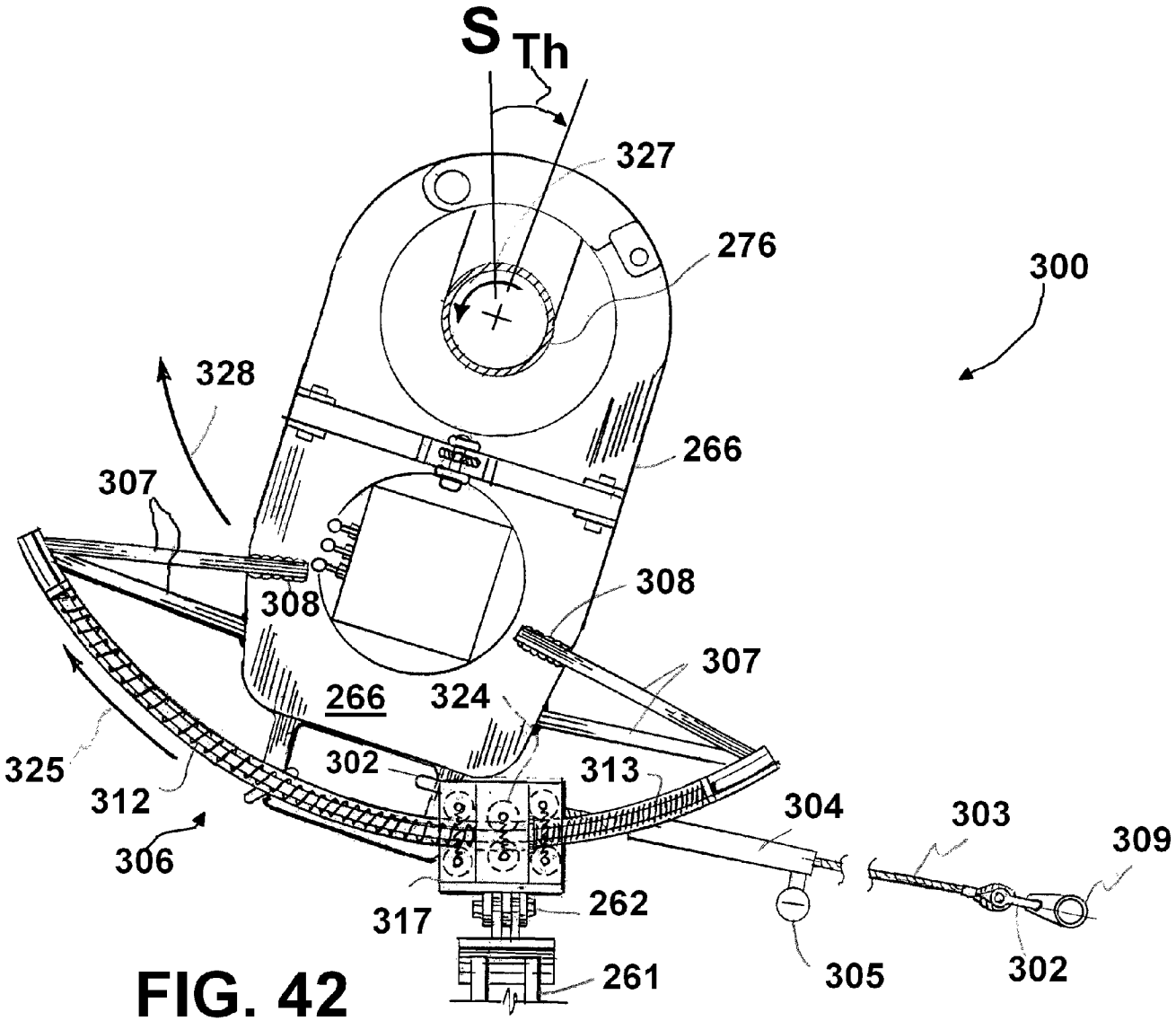
FIG. 42 is a plan view of the third embodiment of the apparatus of the present invention.

In some situations, it is desirable to rotate upper tubular section 276 of drill pipe with the power tong 266 in one direction (as indicated by arrow 327 in FIG. 42). In such a case, a reaction torque/rotation could be transferred to the lower end portion 59 or 261 of arm 50 or 250 causing a bending or twisting of this arm. Therefore, in one embodiment power tong 266 is allowed to rotationally float in a horizontal plane relative to arm 250. In one embodiment a snub line 303 and floating bow structure 306 is provided which is connected attached to power tong 266. Floating bow structure 306 forms for rotational between end 59 or 261 and power tong 266, and allows substantially free rotation in a substantially horizontal plane between power tong 266 and end 59 or 261 (at least until snub line 303 becomes taut and resists further rotation of power tong 266). The snub line 303 is the absolute determinate preventing horizontal rotation of the tong 266 at the instant the snub line 303 becomes stretched tight. At such time the torque applied to the tubular 276 by power tong 266 can be determined through a reading on torque gauge 305 or on a torque turn computer based on the moment arm handle "H".

In one embodiment tong 266 is allowed to rotate horizontally relative to arm 50 or 250, whereby damage will not occur to the arm which remains in line with the well bore (or the center of tubular 276). Without this ability of the power tong 266 to horizontally float relative to the positioner (such as provided by the arrangement of FIGS. 40-48), damage could occur to the positioning forward arm 50 or forward member 250 at the point of attachment 262 when the power tong 266 attempted to rotate in the opposite direction of that the power tong was attempting to rotate tubular 276. Without the ability of power tong 266 to float in a horizontal plane relative to the tong positioner, arm 50 or 250 would attempt to resist the reaction torque applied by tubular 276 to power tong 266 (at least until some other items resists the reaction torque—such as where snub line 303 becomes taut). It is expected that snub line 303 will have some slack and therefore without the floating of power tong 266 relative to the tong positioner, the positioner is expected to be damaged. The arm forward arm 50 or 250 could become damaged because of the radial arc horizontally applied at the point of attachment of the arm 50 or 250 to the tong 266. In one embodiment allowed amount of horizontal rotation of the tong 266 along a radial arc is approximately fifteen to eighteen inches before snub line snub line 303 becomes tight, and further depending on the slack in the snub line 303. The snub line 303 should not have any more slack than needed and must not have more slack than the allowed radial travel distance of housing 317, 331 (e.g., 2, 4, 6, 8, 10, 12, 14, 16, 18, 20, 22, 24, 30, or 36 inches) (5, 10, 15, 20, 25, 35, 40, 45, 50, 55, 60, 75, or 90 centimeters) upon the bow structure 306. Otherwise, further floating of power tong 266 will not occur and damage could occur to the forward arm 50, 250 by the rotation/torque being transferred to the arm 50, 250.

The amount of torque that is being transferred to the drill pipe 276 can be calculated using a load cell 304 and dial 305 or a similar readout rigged as part of the snub line 303. Thus, the snub line 303 can be a sling or slings 303 attached between an anchor point 309 and to eyelet 301 on power tong 266 (e.g. using shackles 302).

When the power tong 266 is actuated, it rotates drill pipe 276 in the direction of arrow 327. As indicated in FIG. 42, in reaction to such rotation transferred to pipe 276, the power tong 266 is rotated in the direction of arrow 328. This reaction causes the bow structure 306 to travel in the direction of arrow 329 in FIG. 42. Snub line 303 prevents the transmission of substantial torque to the lower end portion 59 or 261 of the forward arm member 50 or 250. A pair of return springs 312, 313 are mounted on upper curved beam 311.

Figure 40:
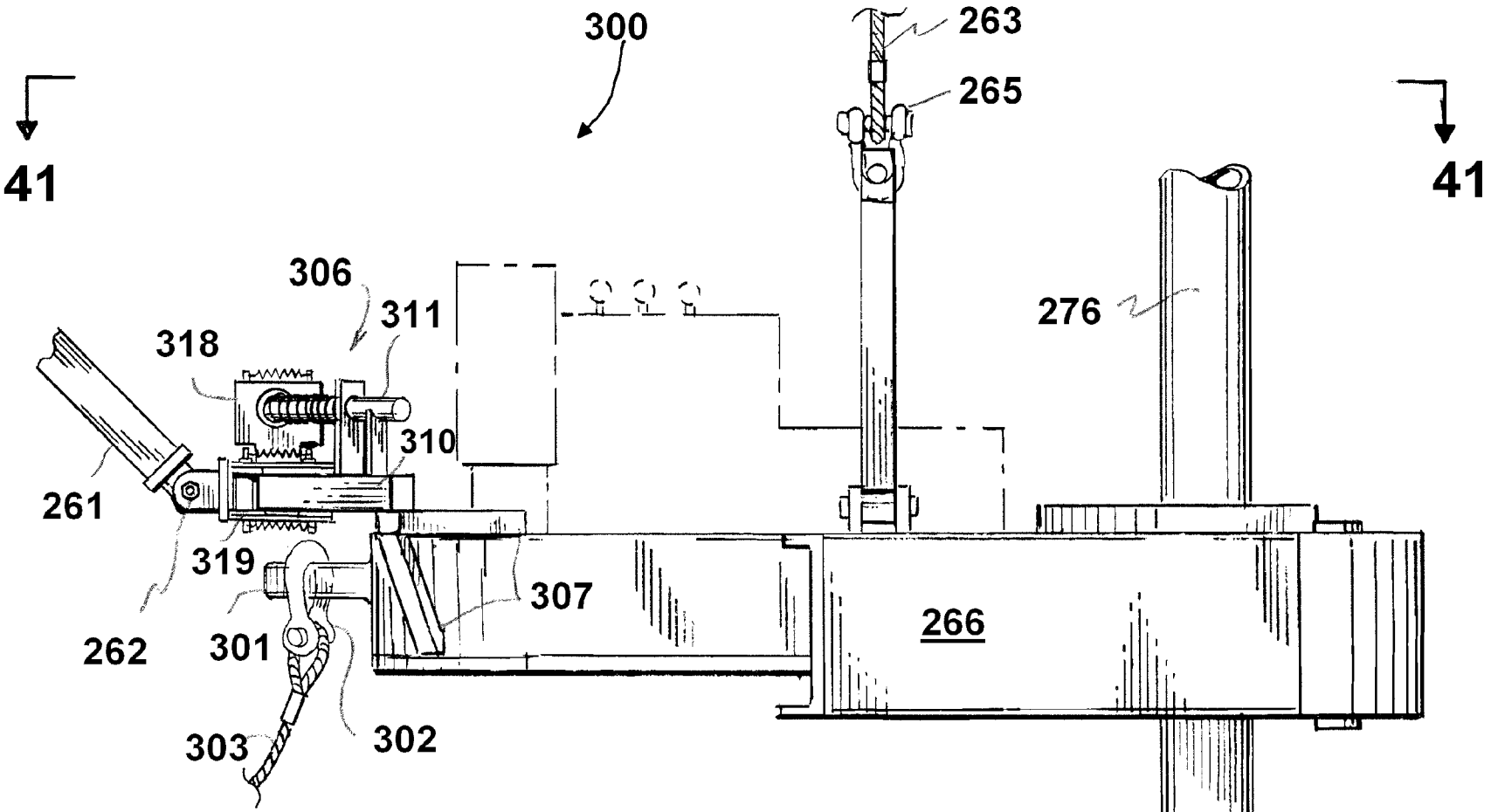
FIG. 40 is an elevation view of a third embodiment of the apparatus of the present invention.
Figure 41:
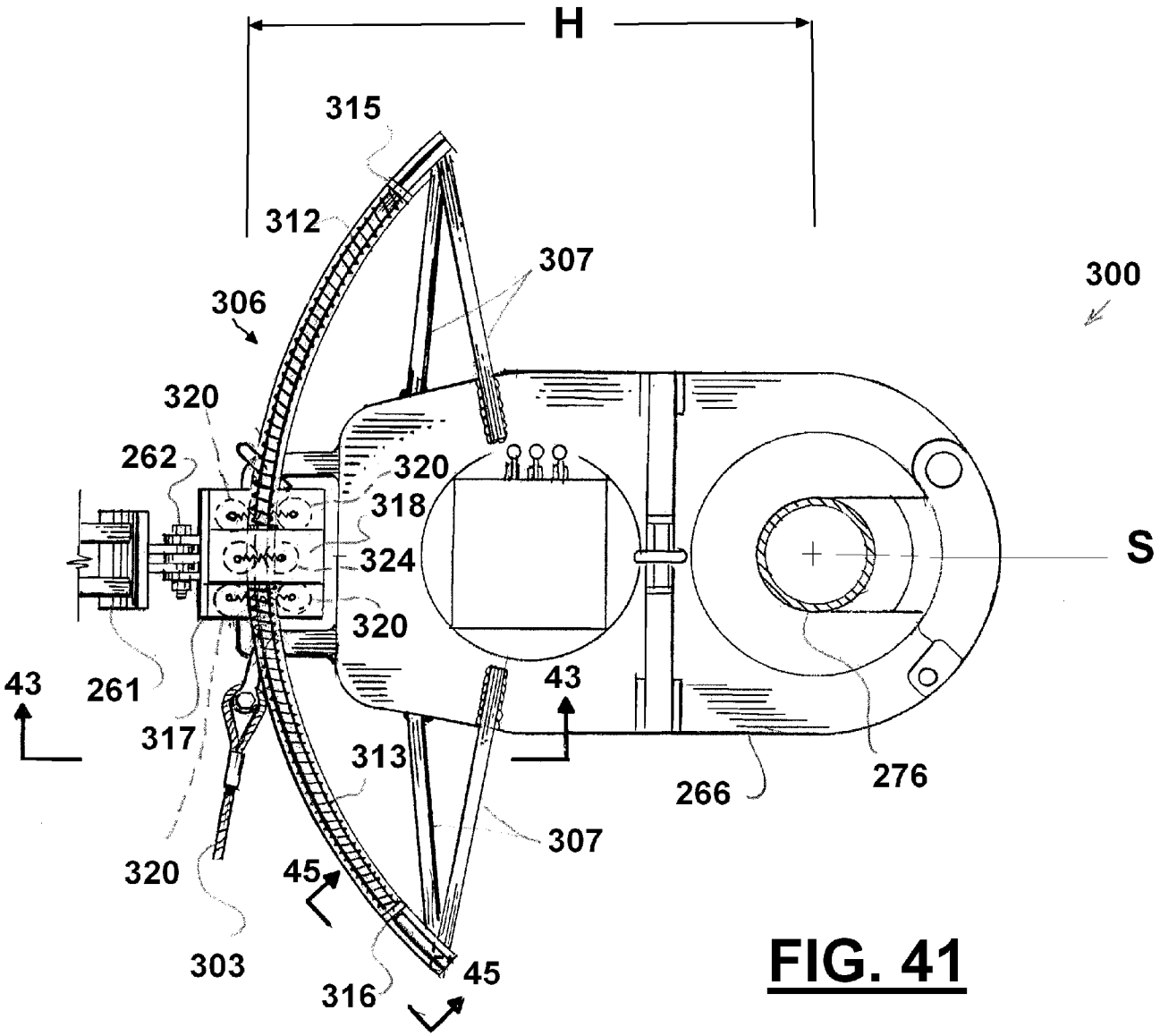
FIG. 41 is a plan view taken along lines 41-41 of FIG. 40.

FIGS. 40 through 41 shown one embodiment where power tong 276 can float relative to tong positioner. The bow structure 306 can include a lower curved beam 310 and an upper curved beam 311. A plurality of struts 307 and welded connections 308 can connect bow structure 306 to power tong 266.

In one embodiment a system is provided for automatically repositioning power tongs 266 to a desired starting position after power tongs 266 are no longer applying torque to tubular 276. In one embodiment the automatic positioner can include a biasing member 312. In one embodiment the automatic positioner can include a plurality of biasing members 312, 313. Depending on the direction of torque applied by power tongs 266 on tubular 276, power tong 266 will tend to rotate in the opposite direction (e.g., either clockwise or counter clockwise). In FIG. 42 a clockwise rotation of power tong 266 is shown by an angle theta relative to the starting position S shown in FIG. 41. During the rotation of power tong 266 by angle theta, return spring 313 is compressed and return spring 312 is stretched (when torque is applied by the power tong 266 to the drill pipe 276). After the torque is removed springs 312 and 313 will apply enough force to relocate power tong 266 to its starting position at S (position S is shown in FIG. 41). Springs 312 and 313 can be helical springs.

Figure 45:
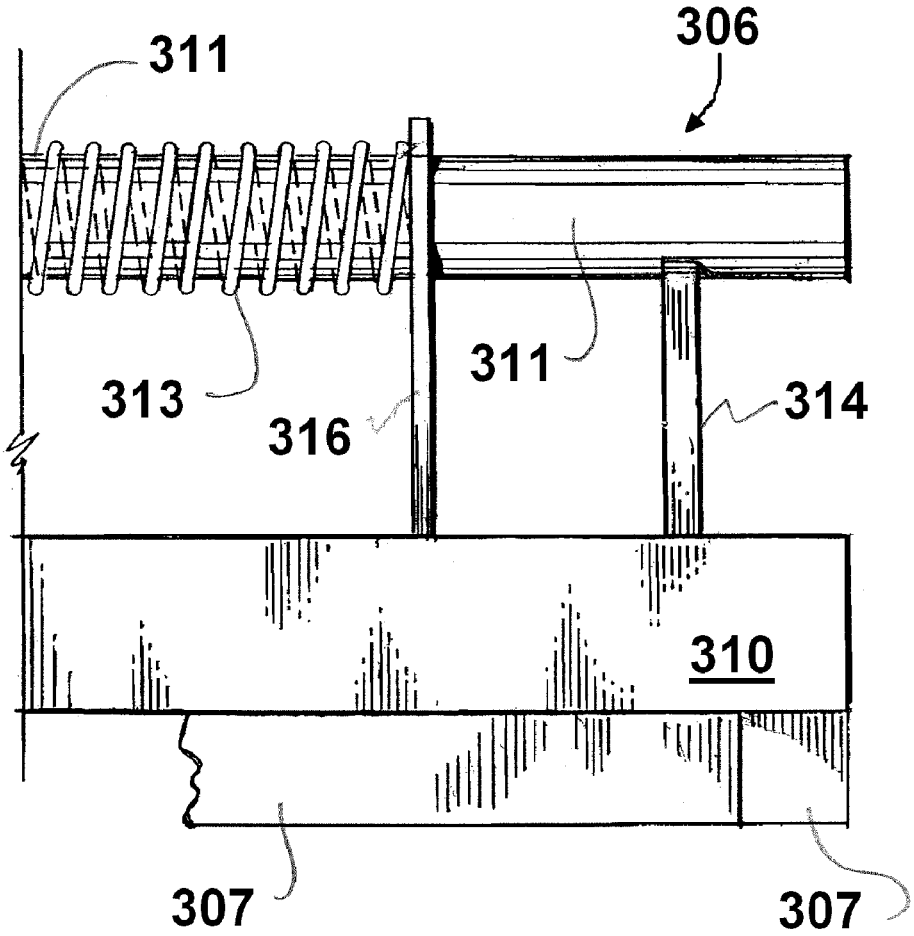
FIG. 45 is a sectional view taken along lines 45-45 of FIG. 41.
Figure 48:
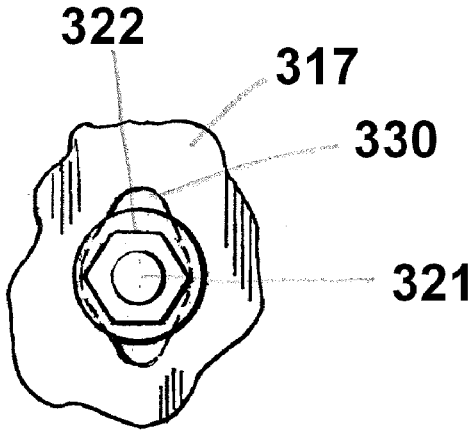
FIG. 48 is a fragmentary view of the third embodiment of the apparatus of the present invention.

The upper curved beam 311 and lower curved beam 310 can be connected using one or more supports 314 as shown in FIG. 45. These can be sections of plate that are connected to the end portions of the curved beams 310, 311 using welded connections for example. Stops are provided at 315, 316 for preventing removal of either return spring 312, 313 from upper curved beam 311.

Figure 43:
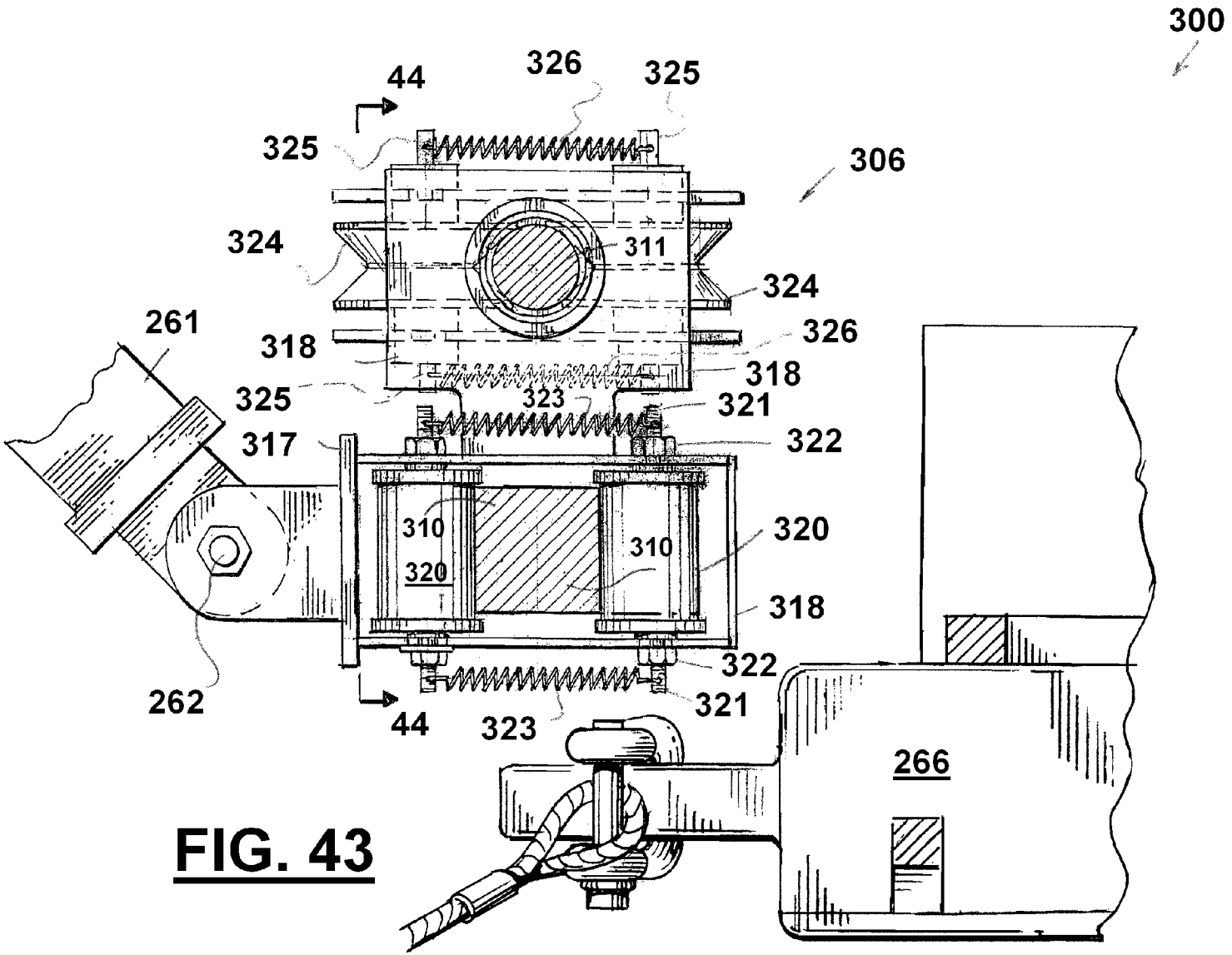
FIG. 43 is a partial sectional view taken along lines 43-43 of FIG. 41.

A housing 317 is attached to lower end portion 59 or 261 of forward arm member 50 or 250 at pivotal/pinned connection 262 as shown in FIGS. 41-43. The housing 317 includes a housing upper section 318 and a housing lower section 319. The housing lower section 319 provides a plurality of rollers 320, four (4) rollers 320 being shown in the drawings.

Figure 44:
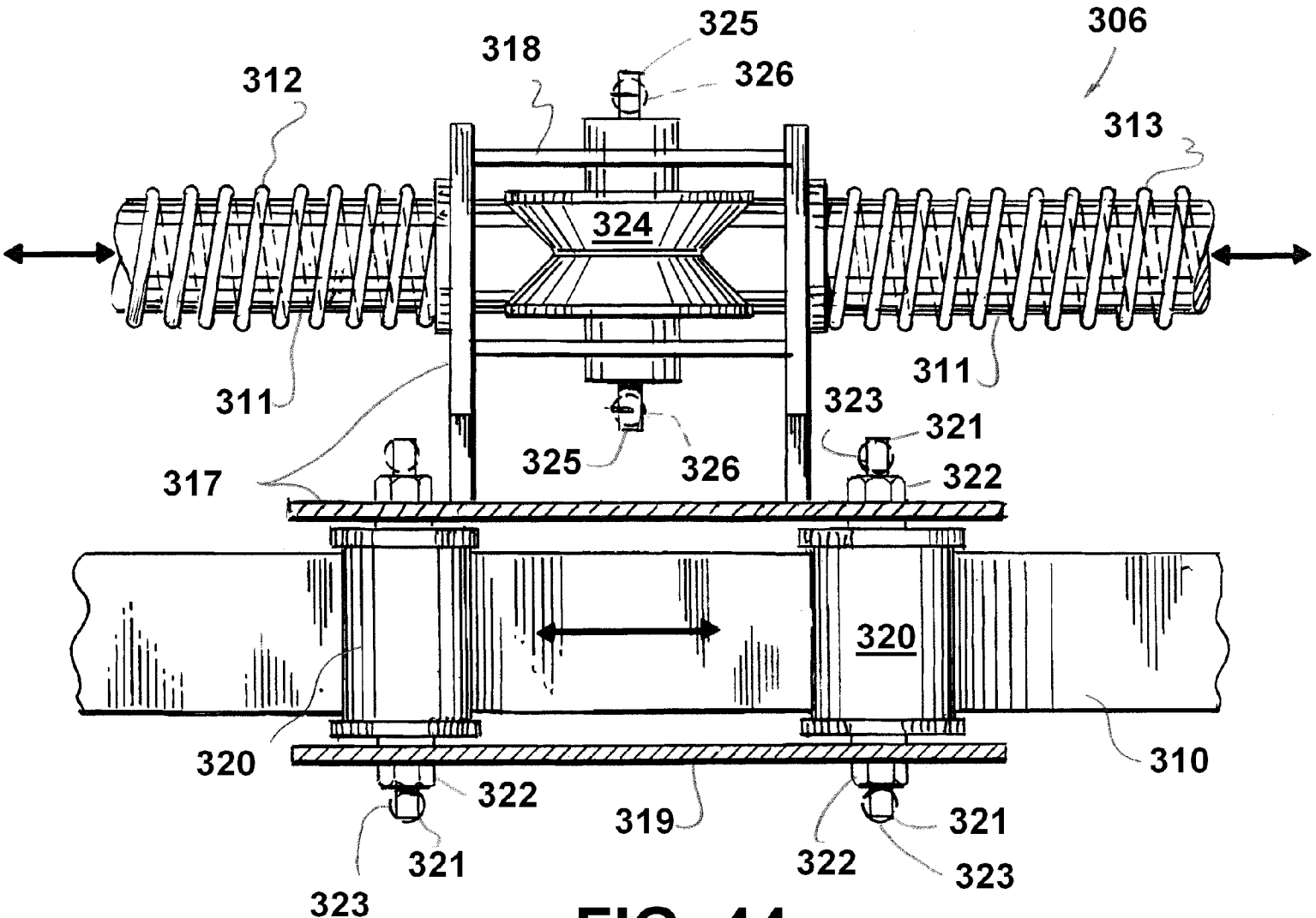
FIG. 44 is a partial sectional view taken along lines 44-44 of FIG. 43.

Each roller 320 is mounted upon a roller shaft 321 that is secured to housing 317 lower section 319 using nuts 322 and springs 323. Roller shaft 321 can have externally threaded ends that are receptive of nuts 322. A slot 330 can be provided in housing 317 for allowing some play for each of the roller shafts 321 relative to the housing 317. This arrangement enables the rollers 320 to closely conform to the outer surface of the lower curved beam 310. Springs 323 pull each pair of rollers 320 toward the beam 310 as shown in FIGS. 43 and 44. Springs 323 are thus provided at each end portion of each roller shaft 321 as shown.

Upper curved beam 311 interfaces with housing 317 upper section 318 using a plurality of sheaves 324. Each sheave 324 is mounted upon a sheave shaft 325. Pairs of the sheaves 324 and sheave shafts 325 are mounted on opposing sides of upper curved beam 311 as shown in FIGS. 41-44 and 46. The spring loaded rollers 320 and spring loaded sheaves 324 provide for smooth travel of the housing 317 relative to the curved beams 310, 311 even if there are slight imperfections in the curvature of either or both of the beams 310, 311.

Figure 46:
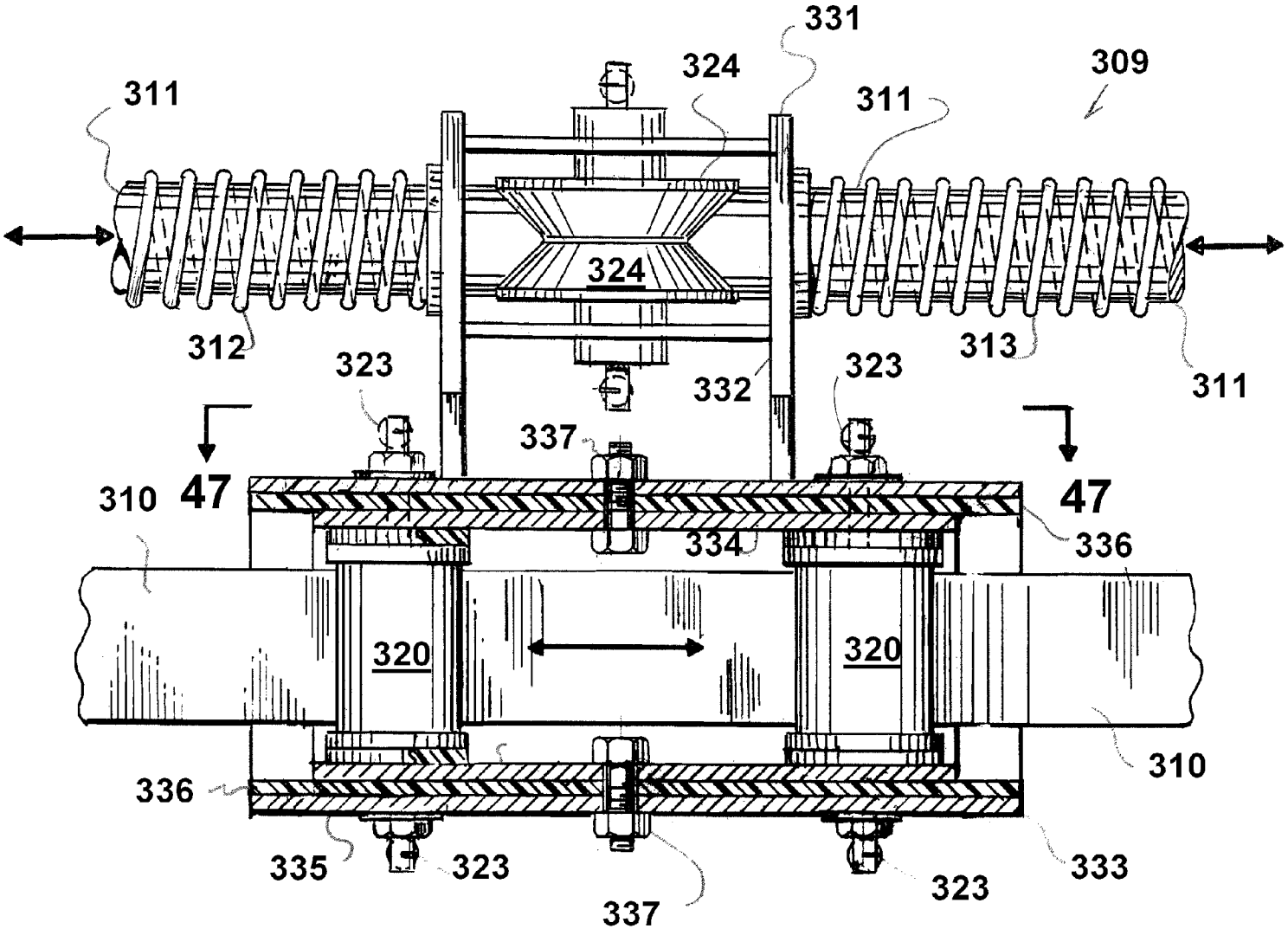
FIG. 46 is a partial sectional view of the third embodiment of the apparatus of the present invention illustrating an alternate construction for the housing lower section.
Figure 47:
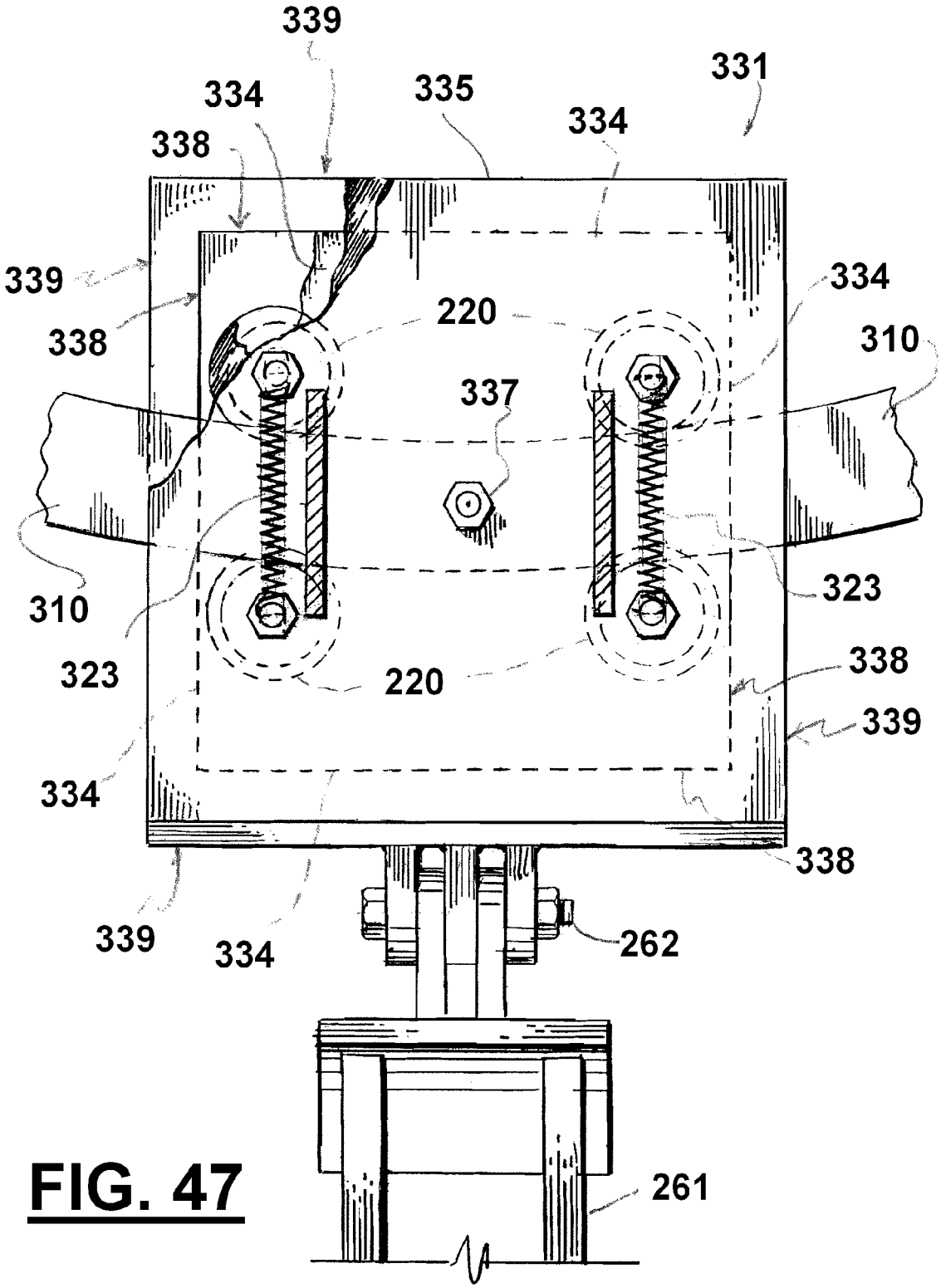
FIG. 47 is a sectional view taken along lines 47-47 of FIG. 46.

FIGS. 46 and 47 show an alternate construction for the housing, designated by the numeral 331. In FIGS. 46 and 47, housing 331 is comprised of a housing upper section 332 and a housing lower section 333. The housing lower section 333 includes an inner box 334, and an outer box 335. Low friction material layers 336 (such as Delrin shim material) can be provided in between the upper and lower end portions of inner box 334 and the outer box 335 as shown in FIG. 46. Bolted connections 337 join the inner box 334 and outer box 335 at positions above and below lower curved beam 310. This arrangement enables the inner and outer boxes 334, 335 to articulate or rotate, one with respect to the other. Notice in FIG. 47 that the periphery 338 of the inner box 334 can be spaced inwardly of the periphery 339 of the outer box 335. The bolted connections 337 can employ slots while providing some play as illustrated in the bolted connection shown in FIG. 48.

Of course, where power tong attempts to rotate tubular 276 in the opposite direction as shown in FIG. 42, then power tong will rotate in the opposite direction as arrow 328 (stretching spring 313 and compressing spring 312) until snub line 303 prevents the transmission of substantial torque to lower end portion 59 or 261. However, in this case a second snub line 303' (although not shown) may be attached to power tong for resisting rotation (and measuring torque) in the direction opposite of arrow 328). Once the torque is removed springs 312 and 313 will move power tong 266 back to the starting position S (as indicated in FIG. 41). In one embodiment snub line 303 can be reconnected to power tong 266 at a more favorable angle to stop rotation in the opposite direction of rotation as shown in FIG. 42 (however reconnecting snub line 303 is expected to be more difficult than supplying a second snub line 303' (and second load cell) for limiting rotation of power tong 266 in the opposite direction as shown in FIG. 42.

It is expected that the spring constants for springs 312, 313 will be strong enough to return power tong 266 to the starting positioning, but not so strong that the force of the springs will have to be added to the load read by the load cell 304 on snub line 303 in determining the torque applied by power tong 266. In this manner it is expected that the force of the springs 312, 313 will be much smaller than the torque load being applied by power tong 266 so that the force of the springs can be ignored without creating substantial error in torque calculations.

In one embodiment a plurality of interchangeable bow structures 306 with varying radiuses of curvature can be provided which can accommodate power tongs 266,266',266" of different sizes (and therefore different turning radiuses).

Low friction bearing materials (such as Delrin) can be placed between various movable parts, such as rollers and their housings or the inner and outer housings of the floating embodiment.

The obvious benefits include fewer personnel in safer enclosed environment; safer for the rig floor personnel; faster with ability to move heavier equipment with less effort; maximizes efficiency and saves time.

The following is a list of suitable parts and materials for the various elements of the preferred embodiment of the present invention.

PARTS LIST

| Parts Number | Description |
|---|---|
| 10 | tong positioning device |
| 12 | base member |
| 14 | flat base plate |
| 16 | lifting eye |
| 17 | rig floor |
| 18 | rectangular box |
| 20 | walls |
| 22 | hydraulic cylinder |
| 24 | piston member |
| 26, 28 | lines |
| 30 | first end |
| 32 | rear support member |
| 34 | first lower port |
| 36 | pin |
| 38 | cotter pin |
| 40 | moment arm |
| 44 | upper end |
| 46 | plate members |
| 42 | inner arm member |
| 48 | bores |
| 50 | forward shock attachment arm/member |
| 49 | bore |
| 47 | forward upright support member |
| 60 | frames |
| 62 | upright members |
| 64 | point |
| 66 | horizontal members |
| 67 | ends |
| 53 | u-shaped connector member |
| 55 | bolt |
| 57 | bolt |
| 54, 56 | first and second portions |
| 59 | second end |
| 60 | cylinders |
| 70 | shock absorbing member |
| 59 | second end |
| 72 | points |
| 73, 75 | sections |
| 74 | tong support member |
| 76 | bolt |
| 80 | power tong |
| 90 | pipe |
| 100 | cable |
| 82 | handles |
| 84 | handles |
| 102 | arrow |
| 105 | arrow |
| 106 | arrow |
| 108 | arrow |
| 109 | arrow |
| 110 | arrow |
| 114 | arrow |
| 120 | rectangular box portion |
| 122 | sidewalls |
| 124 | upper wall |
| 126 | rear wall |
| 128 | interior space |
| 130 | front face |
| 131 | second component |
| 132 | upright portion |
| 134 | sidewalls |
| 135 | plate |
| 136 | end wall |
| 137 | point |
| 138 | upper portion |
| 139 | arrow |
| 140 | top portion |
| 142 | forward phase |
| 134 | semi-circular plate |
| 135 | point |
| 136 | arrow |

-continued

PARTS LIST

| Parts Number | Description |
|---|---|
| 150 | support members |
| 151 | support frame |
| 152 | arms |
| 153 | cover |
| 154 | upper end |
| 156 | lower end |
| 160 | scaffolding |
| 162 | scaffold board |
| 164 | first frame |
| 166 | single leg |
| 168 | support frame |
| 170 | opening |
| 171 | second frame |
| 172 | legs |
| 174 | opening |
| 176 | vertical positioning apparatus |
| 178 | hydraulic cylinder |
| 180 | rig cable |
| 200 | guide and alignment system |
| 203 | lower power tong section |
| 204, 205 | tubular guides |
| 206 | forward portions |
| 208 | point |
| 209 | pivot points |
| 210 | arrows |
| 211 | arrows |
| 212 | cameras |
| 214 | space |
| 216 | rear alignment pad |
| 217 | alignment device |
| 218 | arm |
| 220 | guide pads |
| 221 | tong positioning apparatus |
| 222 | well drilling rig floor |
| 223 | base |
| 224 | bolted connection |
| 225 | pedestal |
| 226 | lower plate |
| 227 | upper plate |
| 228 | bearing layer |
| 229 | horizontal shaft |
| 230 | vertical plate |
| 231 | roller |
| 232 | vertical shaft |
| 233 | roller |
| 234 | periphery |
| 235 | under surface |
| 236 | gear |
| 237 | vertical shaft |
| 238 | key |
| 239 | bolt |
| 240 | sleeve |
| 241 | gear |
| 242 | arrow |
| 243 | column |
| 244 | column |
| 245 | pivotal connection |
| 246 | intermediate member |
| 247 | upper end portion |
| 248 | lower end portion |
| 249 | link |
| 250 | forward member/arm |
| 251 | pivotal connection |
| 252 | hydraulic cylinder |
| 253 | cylinder |
| 254 | pushrod |
| 255 | pivotal connection |
| 256 | pivotal connection |
| 257 | column |
| 258 | upper section |
| 259 | lower section |
| 260 | shock absorber |
| 261 | lower end portion |
| 262 | pivotal/pinned connection |
| 263 | crane lift line |

-continued

PARTS LIST

| Parts Number | Description |
|---|---|
| 264 | crane hook |
| 265 | shackle |
| 266 | power tong |
| 267 | column |
| 268 | column |
| 269 | opening |
| 270 | spacer plate |
| 271 | bearing layer |
| 272 | shoulder |
| 273 | hydraulic motor |
| 274 | gear box |
| 275 | shaft |
| 276 | drill pipe |
| 277 | worm gear motor drive |
| 278 | cylinder support |
| 279 | lug |
| 280 | lug |
| 281 | pivotal connection |
| 282 | pivotal connection |
| 283 | hydraulic cylinder |
| 284 | hydraulic cylinder |
| 285 | pushrod |
| 286 | lug |
| 287 | lug |
| 288 | pivotal connection |
| 289 | pivotal connection |
| 290 | arrow |
| 291 | arrow |
| 292 | arrow |
| 293 | mud bucket |
| 294 | slip |
| 295 | guide |
| 300 | tong positioning device |
| 301 | eyelet |
| 302 | shackle |
| 303 | sling/snub line |
| 304 | load cell |
| 305 | dial |
| 306 | bow structure |
| 307 | strut |
| 308 | weld |
| 309 | anchor point |
| 310 | lower curved beam |
| 311 | upper curved beam |
| 312 | return spring |
| 313 | return spring |
| 314 | support |
| 315 | stop |
| 316 | stop |
| 317 | housing |
| 318 | housing upper section |
| 319 | housing lower section |
| 320 | roller |
| 321 | roller shaft |
| 322 | nut |
| 323 | spring |
| 324 | sheave |
| 325 | sheave shaft |
| 326 | spring |
| 327 | arrow |
| 328 | arrow |
| 329 | arrow |
| 330 | slot |
| 331 | housing |
| 332 | housing upper section |
| 333 | housing upper section |
| 334 | inner box |
| 335 | outer box |
| 336 | low friction layer |
| 337 | bolted connection |
| 338 | periphery |
| 339 | periphery |

The foregoing embodiments are presented by way of example only; the scope of the present invention is to be limited only by the following claims.

The invention claimed is:

1. A tong positioning apparatus, comprising:

(a) a base, including a powered cylinder;

(b) a first articulating arm attached at a first end to the cylinder and pivotally attached to the base;

(c) a second arm attached at a first end to a second end of the first articulating arm;

(d) a tong attached to a second end of the second arm, so that when the cylinder moves from retracted and expanded positions, the first and second arms articulate to move the tong between engaged and disengaged positions relative to conjoined tubular members; and (e) a bow structure forming an interface between the tong and the second arm that enables rotation about a generally vertical axis and with respect to an underlying support surface; and (f) wherein the bow structure includes a housing having upper and lower housing sections, a curved beam attached to the upper housing section and a curved beam attached to the lower housing section, at least one of the beams being connected to the tong for movement therewith along an arcuate path.

2. The tong positioning apparatus of claim 1, wherein at least one of the curved beams is fitted with a pair of return springs that urge the beam to move to a centered position upon the housing.

3. The tong positioning apparatus of claim 1, wherein at least one of the housing sections includes inner and outer boxes that are pinned together.

4. The tong positioning apparatus of claim 1, wherein at least one of the housing sections includes inner and outer boxes that are movably connected together.

5. The tong positioning apparatus of claim 1, wherein at least one of the beams is curved and defines a part of a circle that is less than 180 degrees of curvature.

6. The tong positioning apparatus of claim 5, wherein each of the beams is curved and defines a part of a circle that is less than 180 degrees of curvature.

7. The tong positioning apparatus of claim 1, further comprising rollers that define an interface between each of the housing sections and a beam.

8. A tong positioning apparatus, comprising:

(a) a base, including a powered cylinder;

(b) a first articulating arm attached at a first end to the cylinder and pivotally attached to the base;

(c) a second arm attached at a first end to a second end of the first articulating arm;

(d) a tong attached to a second end of the second arm, so that when the cylinder moves from retracted and expanded positions, the first and second arms articulate to move the tong between engaged and disengaged positions relative to conjoined tubular members; and (e) a bow structure forming an interface between the tong and the second arm that enables rotation about a generally vertical axis and with respect to an underlying support surface;

(f) wherein the bow structure includes: (i) a housing and at least one curved beam that moves relative to the housing, (ii) the beam being connected to the tong for movement therewith along an arcuate path, and (iii) rollers that define an interface between the housing and the beam.

* * * * *